US007758700B2

(12) United States Patent
Fuchigami et al.

(10) Patent No.: US 7,758,700 B2
(45) Date of Patent: Jul. 20, 2010

(54) POWDER CONTAINER, CLEANING METHOD AND CLEANING APPARATUS FOR CLEANING THE POWER CONTAINER

(75) Inventors: Akihiro Fuchigami, Yokohama (JP); Toshiyuki Mutoh, Yokohama (JP); Yoichi Okamoto, Atsugi (JP); Shigeru Yamada, Yokohama (JP); Tomoyasu Hirasawa, Setagaya-ku (JP)

(73) Assignee: Ricoh Company, Ltd., Tokyo (JP)

( * ) Notice: Subject to any disclaimer, the term of this patent is extended or adjusted under 35 U.S.C. 154(b) by 389 days.

(21) Appl. No.: 11/573,787

(22) PCT Filed: Aug. 12, 2005

(86) PCT No.: PCT/JP2005/015115

§ 371 (c)(1),
(2), (4) Date: Feb. 16, 2007

(87) PCT Pub. No.: WO2006/019150

PCT Pub. Date: Feb. 23, 2006

(65) Prior Publication Data

US 2007/0295363 A1 Dec. 27, 2007

(30) Foreign Application Priority Data

Aug. 20, 2004 (JP) ..... 2004-240844

(51) Int. Cl.
*B08B 9/08* (2006.01)
*B08B 9/20* (2006.01)
*A47L 13/40* (2006.01)

(52) U.S. Cl. ..... 134/8; 134/22.1; 134/25.1; 15/1.51

(58) Field of Classification Search ..... 134/22.1, 134/25.1, 166 R, 182; 220/4.26, 23.86, 694
See application file for complete search history.

(56) References Cited

U.S. PATENT DOCUMENTS 3,265,369 A * 8/1966 Harrison ..... 366/274
3,645,284 A * 2/1972 Krezanoski et al. ..... 134/166 R
6,079,429 A * 6/2000 Zarich ..... 134/182
6,278,853 B1 * 8/2001 Ban et al. ..... 399/109

FOREIGN PATENT DOCUMENTS

JP 07-306576 11/1995

(Continued)

OTHER PUBLICATIONS

U.S. Appl. No. 12/244,193, filed Oct. 2, 2008, Murakami, et al.

*Primary Examiner*—Michael Kornakov
*Assistant Examiner*—Natasha Campbell
(74) *Attorney, Agent, or Firm*—Oblon, Spivak, McClelland, Maier & Neustadt, L.L.P.

(57) ABSTRACT

A cleaning method for cleaning a powder container by introducing a cleaning medium into the powder container from a first opening part of the powder container for attaching powder in the powder container to the cleaning medium and discharging the cleaning medium together with the powder from a second opening part situated opposite from the first opening part is disclosed. The method includes a step of releasing the cleaning medium from a position higher than the first opening part of the powder container.

20 Claims, 17 Drawing Sheets

FOREIGN PATENT DOCUMENTS

| | | | |
|---|---|---|---|
| JP | 08-173922 | | 7/1996 |
| JP | 08-328368 | | 12/1996 |
| JP | 11-090368 | * | 4/1999 |
| JP | 2000-147878 | | 5/2000 |
| JP | 2002-268383 | | 9/2002 |
| JP | 2003-122123 | | 4/2003 |

* cited by examiner

BEFORE CLEANING PROCESS

MIDDLE OF CLEANING PROCESS

POWDER CONTAINER, CLEANING METHOD AND CLEANING APPARATUS FOR CLEANING THE POWER CONTAINER

TECHNICAL FIELD

The present invention relates to a powder container, a cleaning method and a cleaning apparatus for cleaning the powder container, and more particularly to a powder container, a cleaning method and a cleaning apparatus for cleaning the powder container for efficiently removing powder such as toner remaining in a powder container or a development unit, for example.

BACKGROUND ART

Toner supply containers (e.g. toner bottles, toner cartridges, development units), which contain toner to be supplied to image forming apparatuses, are desired to be reused for environmental protection purposes. However, the process for reusing the toner supply containers results in a considerable cost. The cost mainly consists of the cost for recollecting the toner supply containers and the cost for cleaning the toner supply containers.

The toner, which cannot fulfill various process conditions, is left remaining in the recollected toner supply containers (toner containers). The remaining toner is usually a poor quality toner which coagulates or has a poor charging property, for example. Therefore, in order to ensure the quality of the recycled toner container, it is necessary to remove the remaining toner from the toner container and clean (wash) the inside of the toner container.

Since the toner containers are currently cleaned at a factory having a large-sized facility dedicated for cleaning the toner containers, it is difficult to clean the toner containers at a low cost. Furthermore, since many conventional cleaning processes employ a wet type cleaning method using a cleaning liquid, the conventional cleaning process is complicated. This also results in high cleaning cost. Furthermore, the wet type cleaning method consumes a large amount of energy for disposing the used cleaning liquid and drying the cleaned toner containers. Therefore, the wet type cleaning method is not an ideal method from the aspect of protecting environmental resources.

Japanese Laid-Open Patent Application Nos. 8-173922 and 11-90368 disclose a method of removing residual toner powder remaining (adhering) on the inner and outer surfaces of a powder container containing dry toner for electrophotography, for example. This method employs a cleaning apparatus having an air-blowing part for air-blowing the portion at which the residual toner powder remains and a powder collecting part for collecting the air-blown residual toner powder.

Although this cleaning method may be able to scatter the residual toner powder adhering to the container, the powder collecting part is unable to thoroughly collect the scattered toner powder and leaves toner powder floating inside the container. Furthermore, in a case where the container is made of, for example, resin material, the air-blowing of the toner powder causes friction on the container surface and charges the container surface. The electrostatic force of the charged container surface causes minute scattered toner powder to re-adhere and remain onto the container surface.

In order to improve the efficiency of such a cleaning method, several conventional methods provide multiple oppositely situated opening parts to a development unit or a container. Examples of these conventional methods are shown in Japanese Laid-Open Application Nos. 7-306576 (Toner Container and Cleaning Method), 8-328368 (Development Unit and Cleaning Unit), and 2000-147878 (Recycling Method for Toner Supply Container).

These conventional methods commonly provide a cleaning method in which a high pressure air stream is delivered from one opening part and suctioned out from the other opening part. This cleaning method is a dry type cleaning method which reduces turbulence of the air flow inside the container and generates a powerful toner removing force.

However, the residual stain remaining on the surface of the used toner container not only includes the toner simply adhering onto the surface of the toner container, but also includes the toner coagulated onto the surface of the toner container after extensive use of the toner container. The coagulated toner remaining on the surface of the toner container cannot be easily removed merely by blowing air thereto and the toner container having such coagulated toner cannot be reused. Furthermore, in a case where the toner container is formed in a complex shape, air may not be sufficiently applied to some areas in the toner container. As a result, toner may re-adhere onto such areas and may be difficult to remove.

In order to solve this problem of the residual stain, Japanese Laid-Open Patent Application No. 2002-268383 discloses a cleaning method using a cleaning medium.

In this cleaning method, a granular material, having characteristics of being easy to supply/dispose of, is introduced into a container for allowing residual toner to become attached to the granular material and be removed from the container surface. This granular material is referred to as a cleaning medium. One example of the cleaning medium is a resin ball. FIG. 1 is a schematic drawing for describing a state where residual stain, mainly comprising toner 200, is attached to the surface of a resin ball (cleaning medium) 100. The toner 200 is attached to the resin ball 100 by electrostatic force. By eliminating the electrostatic force of the resin ball 100, the toner 200 can be separated from the resin ball 100. Thereby, the resin ball 100 can be reused as the cleaning medium.

This cleaning method has the following problem in a case of applying this method to a toner supply container.

When the cleaning medium is delivered into one opening part and out from the other opening part of the toner supply container as in the air-blowing method, the cleaning medium is unable to thoroughly reach every corner of the container and may leave uncovered (untouched) areas in the container. In order to allow the cleaning medium to thoroughly cover the internal surface of the container, it is necessary to conduct a batch process (sequential procedures) of introducing the cleaning member into the container, closing the opening parts of the container, and vibrating or shaking the container for a certain period of time. This batch process requires many procedures and lacks operating efficiency.

DISCLOSURE OF INVENTION

It is a general object of the present invention to provide a powder container, a cleaning apparatus, and a cleaning method that substantially obviate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention can be realized and attained by a powder container, a cleaning apparatus, and a cleaning method particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a cleaning method for cleaning a powder container by introducing a cleaning medium into the powder container from a first opening part of the powder container for attaching powder in the powder container to the cleaning medium and discharging the cleaning medium together with the powder from a second opening part situated opposite from the first opening part, the method including a step of: releasing the cleaning medium from a position higher than the first opening part of the powder container.

Furthermore, the present invention provides a cleaning method for cleaning a powder container by introducing a cleaning medium into the powder container from a first opening part of the powder container for attaching powder in the powder container to the cleaning medium and discharging the cleaning medium together with the powder from a second opening part situated opposite from the first opening part, the method including the steps of: mounting plurality powder containers on top of each other; and releasing the cleaning medium from a position higher than the first opening part of the uppermost powder container among the plural powder containers.

In the cleaning method according to an embodiment of the present invention, the powder containers may be mounted on top of each other with one or more spacers provided therebetween.

In the cleaning method according to an embodiment of the present invention, the cleaning method may further include a step of: controlling the flow of the cleaning medium introduced into the first opening part by providing a flow control part inside the powder container.

In the cleaning method according to an embodiment of the present invention, the cleaning method may further include a step of: controlling the flow of the cleaning medium introduced into the first opening part by providing a flow control part inside the spacer.

Furthermore, the present invention provides a powder container including a first opening part formed in a first end plane of the powder container for introducing a cleaning medium therein; a second opening part formed in a second end plane of the powder container and situated opposite from the first opening part for discharging the cleaning medium from the powder container; and a flow control part for controlling the flow of the cleaning medium introduced from the first opening part.

In the powder container according to an embodiment of the present invention, the flow control part may be tapered in a direction where the cleaning medium is introduced into the first opening part.

In the powder container according to an embodiment of the present invention, the flow control part may include a plurality of members extending in a radial direction.

In the powder container according to an embodiment of the present invention, each of the first and second opening parts may be provided with a connecting part.

In the powder container according to an embodiment of the present invention, one of the connecting parts corresponding to one of the first and second opening parts may be a concave part and the other one of the connecting parts corresponding to the other one of the first and second opening parts may be a convex part.

In the powder container according to an embodiment of the present invention, the connecting part of the first opening part may have an inner diameter that is equal to the outer diameter of the connecting part of the second opening part.

In the powder container according to an embodiment of the present invention, the first and second end planes may be tapered, wherein the angle of the tapers is greater than the angle of repose of the cleaning medium.

In the powder container according to an embodiment of the present invention, the powder container may be configured to be disassembled into a plurality of components, wherein the components are connectable.

Furthermore, the present invention provides a cleaning apparatus for cleaning a powder container by introducing a cleaning medium into the powder container from a first opening part of the powder container for attaching powder in the powder container to the cleaning medium and discharging the cleaning medium together with the powder from a second opening part situated opposite from the first opening part, the cleaning apparatus including: a cleaning medium container for containing the cleaning medium therein; a powder container holding mechanism for holding the powder container; wherein the cleaning medium container is situated at a position higher than the first opening part of the powder container for releasing the cleaning medium from a position higher than the first opening part of the powder container.

Furthermore, the present invention provides a cleaning apparatus for cleaning a powder container by introducing a cleaning medium into the powder container from a first opening part of the powder container for attaching powder in the powder container to the cleaning medium and discharging the cleaning medium together with the powder from a second opening part situated opposite from the first opening part, the cleaning apparatus including: a cleaning medium container for containing the cleaning medium therein; a powder container holding mechanism for holding a plurality of the powder containers that are mounted on top of each other; wherein the cleaning medium container is situated at a position higher than the first opening part of the uppermost powder container among the plural powder containers for releasing the cleaning medium from a position higher than the first opening part of the uppermost powder container.

In the cleaning apparatus according to an embodiment of the present invention, the cleaning apparatus may further include a drive part, wherein the powder container includes a flow control part for controlling the flow of the cleaning medium introduced from the first opening part, wherein the flow control part is driven by the drive part.

In the cleaning apparatus according to an embodiment of the present invention, the powder containers may be mounted on top of each other with one or more spacers provided therebetween.

In the cleaning apparatus according to an embodiment of the present invention, the powder container holding mechanism may include a guide for matching the positions of the powder containers.

BEST MODE FOR CARRYING OUT THE INVENTION

Figure 1:
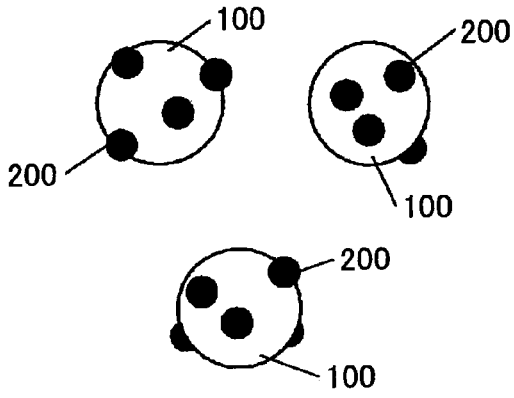
FIG.1 PRIOR ART
FIG. 1 is a schematic view showing spherical cleaning media having toner attached thereto.

The present invention is described in detail based on the embodiments illustrated in the drawings.

First Embodiment

Figure 2:
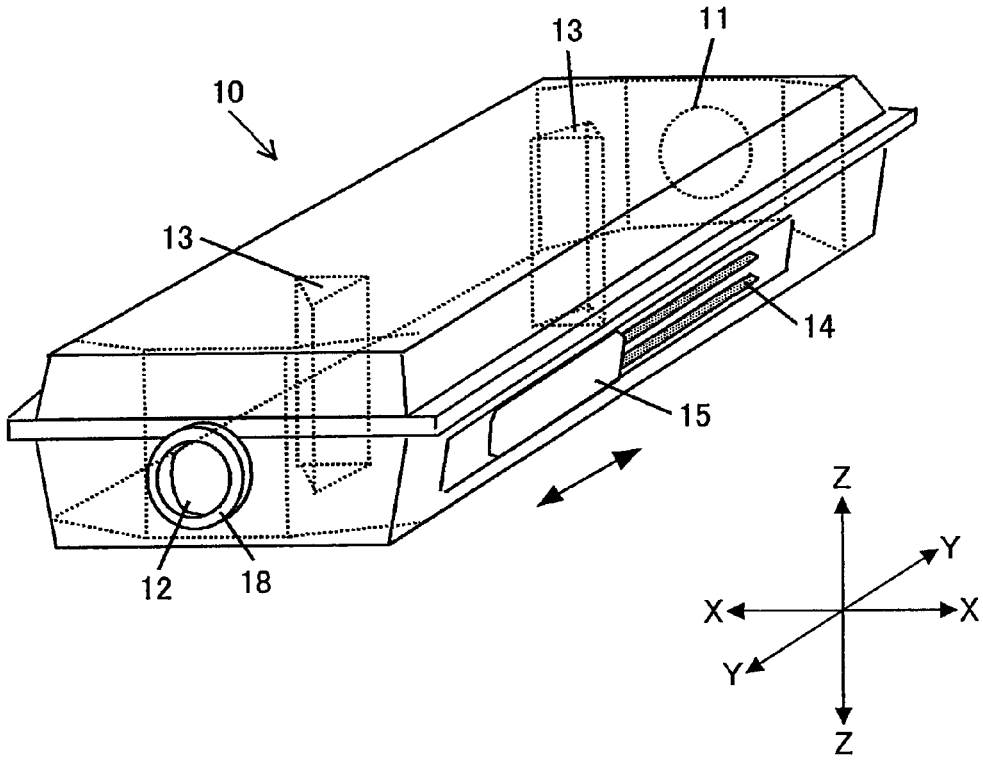
FIG. 2 is a perspective view showing a toner supply container according to a first embodiment of the present invention.
Figure 3A:
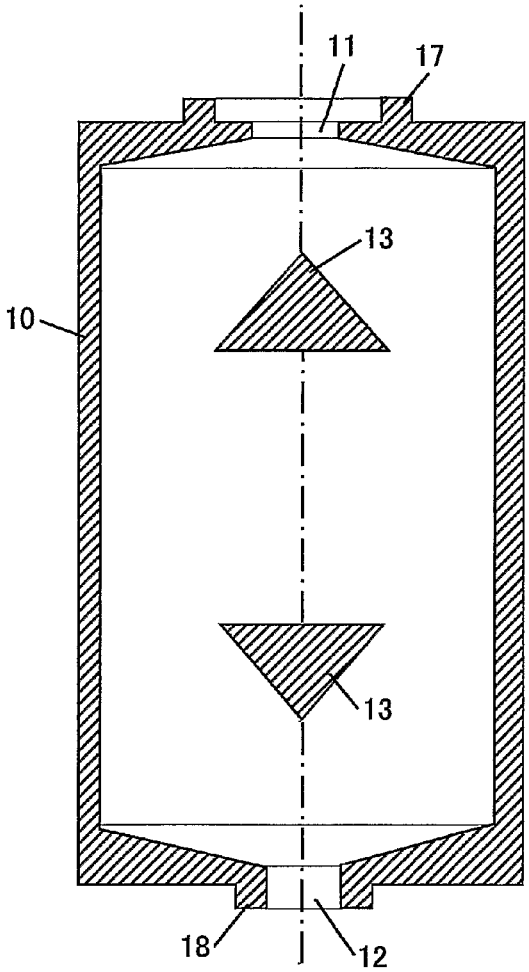
FIG. 3A is a cross-sectional front view showing the toner supply container according to the first embodiment of the present invention.
Figure 3B:
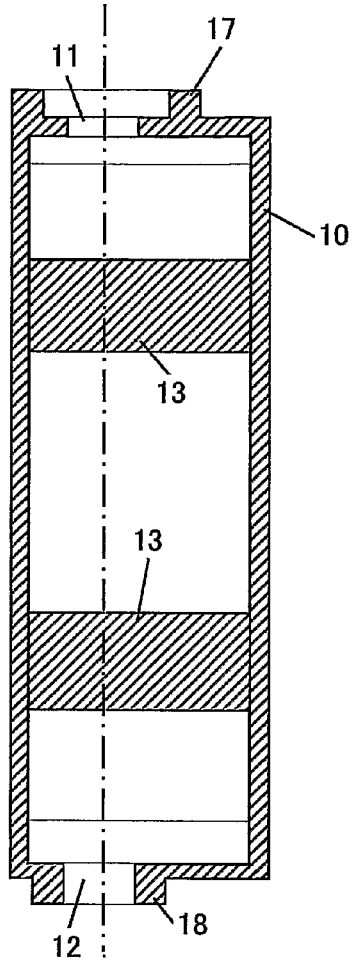
FIG. 3B is a cross-sectional side view showing the toner supply container according to the first embodiment of the present invention.
Figure 4A:
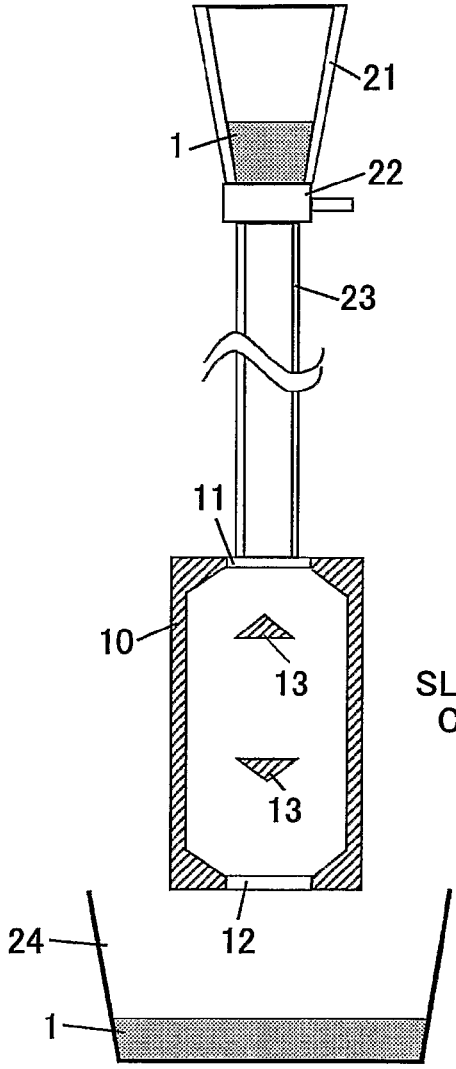
FIG. 4A is a drawing for describing a basic principle of a cleaning method according to the first embodiment of the present invention before performing a cleaning process on the toner supply container.
Figure 4B:
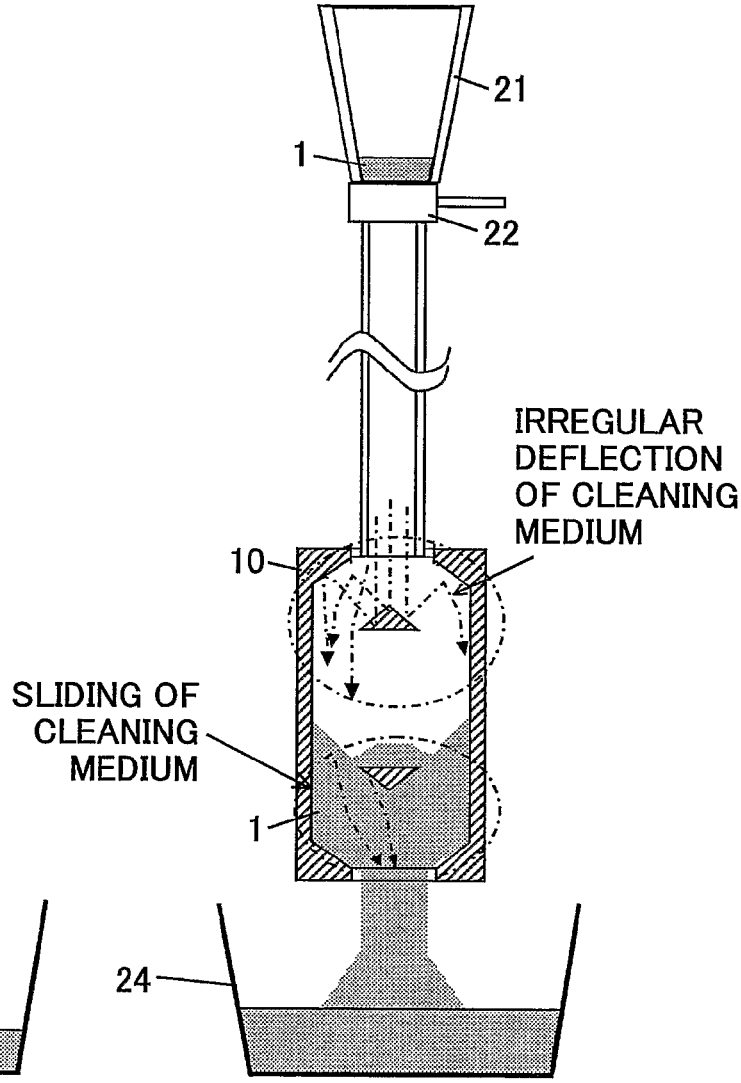
FIG. 4B is a drawing for describing a basic principle of a cleaning method according to the first embodiment of the present invention in the middle of performing a cleaning process on the toner supply container.
Figure 5A:
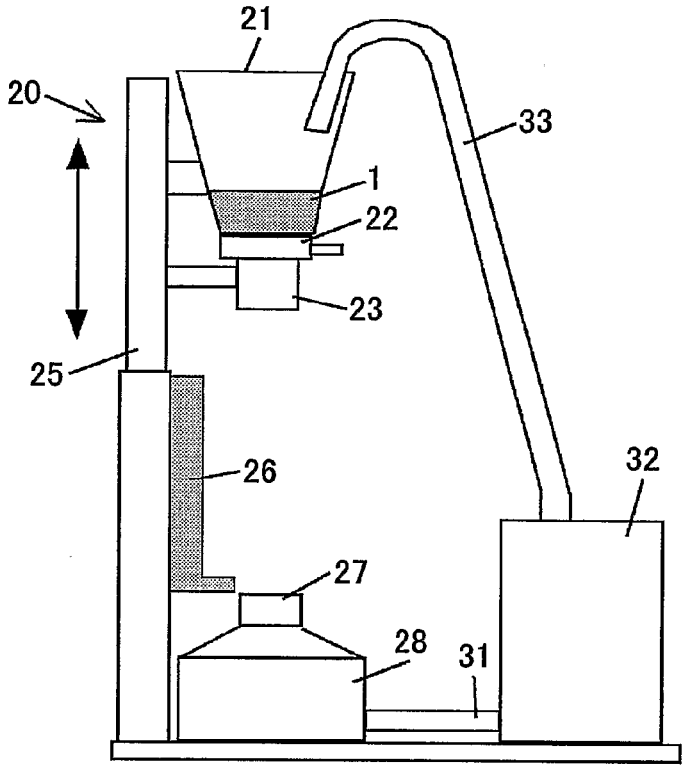
FIG. 5A is a schematic view of a cleaning apparatus according to the first embodiment of the present invention in a state where a toner supply container is not mounted thereto.
Figure 5B:
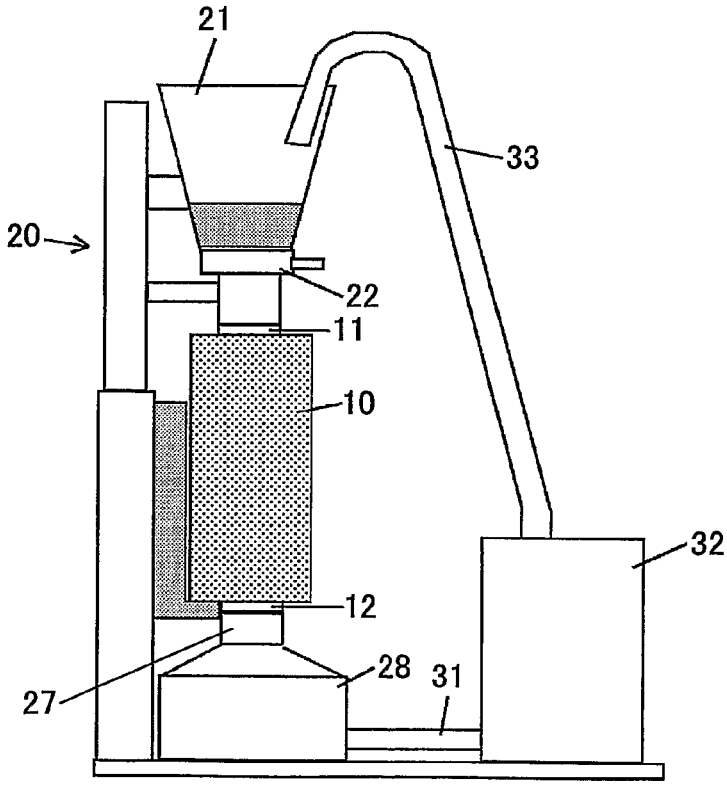
FIG. 5B is a schematic view of a cleaning apparatus according to the first embodiment of the present invention in a state where a toner supply container is mounted thereto.

The first embodiment of the present invention is described with reference to FIGS. 2-5. FIGS. 2, 3A, and 3B are drawing for describing a toner supply container (powder container) 10 according to the first embodiment of the present invention. More specifically, FIG. 2 is a perspective view of the toner supply container 10 according to the first embodiment of the present invention, and FIGS. 3A and 3B are cross-sectional views of the toner supply container 10 according to the first embodiment of the present invention. FIGS. 4A and 4B are drawings for describing a basic principle of a cleaning method according to the first embodiment of the present invention. FIGS. 5A and 5B are schematic drawings for describing a dry-type cleaning apparatus 20 according to an embodiment of the present invention.

The toner supply container 10 according to the first embodiment of the present invention is a toner cartridge having a rectangular solid shape (150 mm×90 mm×50 mm). The configuration of the toner supply container 10 is not to be limited to the rectangular solid shape and may alternatively have a cylindrical shape, for example (See FIG. 3C). The toner supply container 10 has a round opening 11 and another round opening 12 (having diameters of approximately 25 mm) that are provided in the planes (end planes) facing each other in the longitudinal direction of the toner supply container 10. Since the toner supply container 10 has a separate small opening part provided at a side plane thereof for delivering toner to a development unit, there is no particular problem (from the aspect of function) in modifying the design of the opening parts 11, 12 provided for supplying toner. In this example, the inner sides of the end planes to which the opening parts 11, 12 are provided are tapered. Accordingly, when the toner supply container 10 is set in a position for cleaning, the inner sides of the end planes are inclined 10 degrees with respect to the horizontal (See (a) of FIG. 3C). Flow control members 13, which are formed as trianglular-pole-shaped ribs, are provided on a center line of the toner supply container 10 for controlling the flow of a cleaning medium. This allows the cleaning medium introduced from the opening part 11 to collide with the flow control members 13. Although the flow control member 13 in this example has a shape of a trianglular pole, the shape of the flow control member 13 is not limited as long as the cleaning medium can be dispersed and suitably discharged from the container 10. For example, the flow control member 13 may alternatively have a circular conic shape. In a case where the toner supply container 10 is provided with columns (not shown) for ensuring the strength of the container 10, the columns may also serve as the flow control members 13 by modifying the shape of the columns.

Figure 3C:
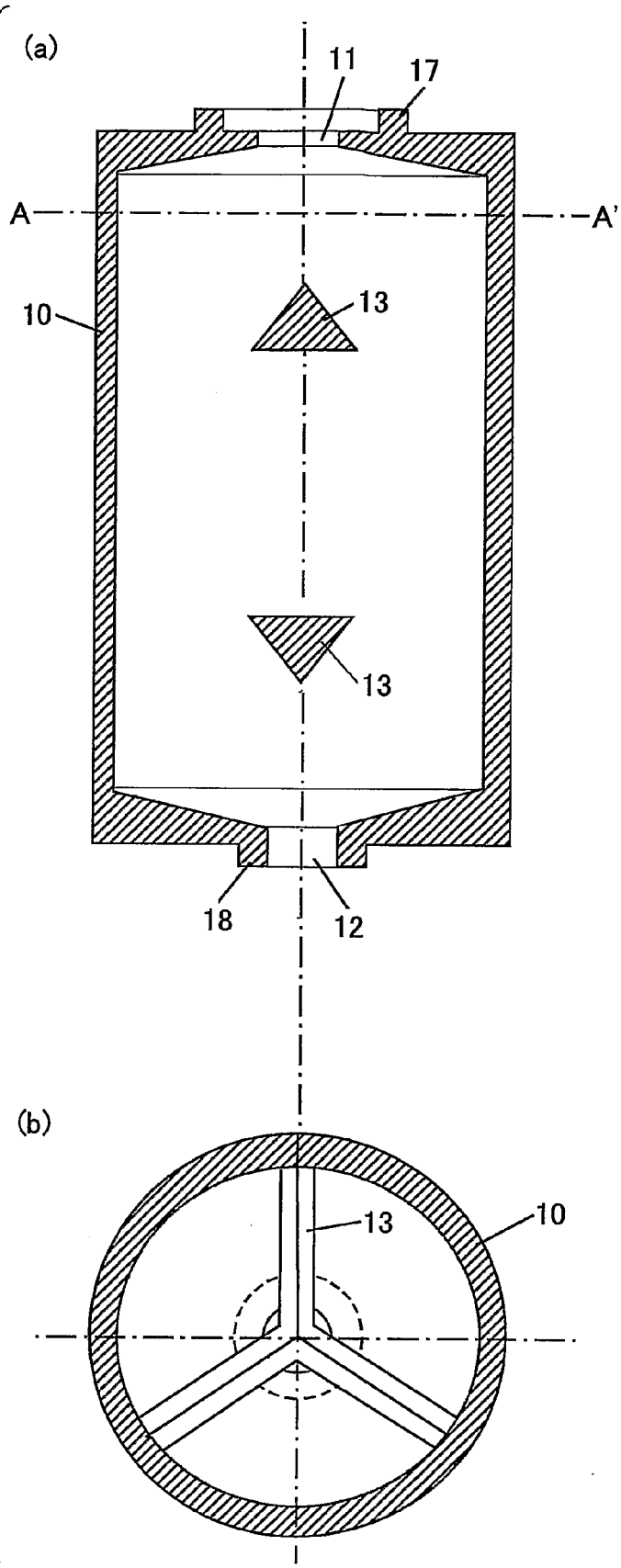
FIG. 3C is a view for describing another toner supply container according to the first embodiment of the present invention, in which (a) is a cross-sectional front view showing another toner supply container according to the first embodiment of the present invention, and (b) is a cross-sectional view of the other toner supply container of (a) taken along line A-A'.

In a case where the toner supply container 10 has a cylindrical shape (See FIG. 3C), the flow control member 13 may be configured with multiple control parts being connected at the center of the flow control member 13 and extending outward in a radiating manner (For example, a configuration similar to the mark of a Mercedes-Benz™ as shown in (b) of FIG. 3C). This configuration allows the cleaning medium to be distributed evenly and uniformly clean the toner supply container 10. Furthermore, the toner supply container 10 includes connecting parts 17 and 18 provided for engagement purposes at the periphery of the opening parts 11 and 12, respectively. The connecting parts 17, 18 may be provided in the form of, for example, a protruding member or a groove.

Next, a basic principle of the cleaning method according to the first embodiment of the present invention is described.

First, in FIG. 4A, a cleaning medium 1 flows down from a hopper 21 through a pipe 23 and collides with the flow control member 13. The collision causes the cleaning medium 1 to be irregularly deflected inside the toner supply container 10. The deflected clean medium 1 contacts and cleans the inner wall of the toner supply container 10 (See FIG. 4B) by separating the residual stain from the inner wall of the toner supply container 10. The residual stain separated from the inner wall of the toner supply container 10 is attached to the cleaning medium 1 by electrostatic force. Accordingly, the residual stain can be prevented from re-adhering to the inner wall of the toner supply container 10.

In a case where the amount of cleaning medium 1 introduced (supplied) into the toner supply container 10 is greater than the amount of the cleaning medium discharged from the toner supply container 10, a portion of the cleaning medium 1 accumulates inside the toner supply container 10, as shown in (b) of FIG. 4. When the sediment cleaning medium 10 is discharged from the opening part 12, the cleaning medium 1 is discharged in a manner sliding against the inner wall of the toner supply container 10. Thereby, the cleaning medium 1 cleans the inner wall of the toner supply container 10 while being discharged from the toner supply container 10. Therefore, even in such a case where the cleaning medium 1 sediments inside the toner supply container 10, the inside of the toner supply container 10 can be cleaned.

In this example of the present invention, the cleaning medium 1 is able to be widely dispersed in the left/right direction by forming the flow control members 13 as trianglular poles with sides tapered in the left/right direction. This can be achieved since the toner supply container 10 in this embodiment of the present invention is a substantially rectangular toner cartridge having a thickness which is less in the front/rear direction (thickness in the Z-Z direction in FIG. 2) than the left/right direction (thickness in the X-X direction in FIG. 2). Since the cleaning media 1 collide with each other when falling in accordance with gravity, the cleaning media 1 have a property of naturally dispersing in the toner supply container 10. In a case where the toner supply container 10 has a substantial thickness in the front/rear direction, the cleaning medium 1 can make contact with the inner wall of the toner supply container 10 and provide a cleaning effect without the forming of the flow control members 13 with sides tapered in the front/rear direction.

Next, the dry-type cleaning apparatus 20 in FIG. 5A according to the first embodiment of the present invention is described.

The cleaning apparatus 20 includes a container holding mechanism 26 onto which the toner supply container 10 is mounted. Furthermore, the cleaning apparatus 20 includes the hopper 21 for containing the cleaning medium 1, and a valve 22 for controlling the supply of the cleaning medium 1. The pipe 23 is positioned between the valve 22 and the opening part 11 (See FIG. 5B) of the toner supply container 10. It is preferable to use a pipe having a smooth inner wall as the pipe 23. Since the difference of height position between the valve 22 and the opening part 11 affects the falling speed of the cleaning medium 11, the valve 22 and the opening part 11 are to be fixed at a height that enables the cleaning medium 1 to fall at a speed adequate for removing the residual stain from the inner wall of the toner supply container 10. The height of the hopper 21 and/or the valve 22 may be adjustable.

Furthermore, the cleaning apparatus 20 also has another pipe 27 to which the opening part 12 of the toner supply container 10 is connected. Through the pipe 27, the cleaning medium 1 having toner attached thereto is discharged from the toner supply container 10 to a cleaning medium container 28 for storing the cleaning medium 1. The cleaning medium 1 stored in the cleaning medium container 28 is supplied to a cleaning medium recycling mechanism 32 via a carrier pipe 31 for carrying granular materials. The residual stain attached to the surface of the cleaning medium 1 is removed in the cleaning medium recycling mechanism 32. The recycled cleaning medium 1 is returned to the hopper 21 via a carrier pipe 33. The carrying of the cleaning medium 1 may be mechanically performed with, for example, a screw type apparatus designed for granular materials.

It is to be noted that the cleaning effect of the down-flowing cleaning medium 1 can be attained not only by positioning the toner supply container 10 in a perpendicular (up-right) state but also in an inclined state.

Next, the procedures of the cleaning method according to the first embodiment of the present invention are described with reference to FIG. 5B.

First, the cleaning medium 1 is supplied to the hopper 21 of the cleaning apparatus 20 (Procedure (I)). As for the material used for the cleaning medium 1, it is desired for the material to have an electrostatic property that attracts residual stain such as toner by electrostatic force. In addition, it is preferable for the material to have satisfactory flow characteristics (mobility) so that the material can easily be discharged (extracted) from the toner supply container 10. Accordingly, it is preferable for the material to be formed as a sphere or in a substantially spherical shape. Since some of the material of the cleaning media 1 might be left remaining inside the toner supply container 10, it may also be preferable to employ a material the same as that of the toner supply container (e.g. resin) or a sublimatic material (e.g. dry ice) in order to prevent any adverse effects due to the remaining material.

The material used as the cleaning medium 1 in the first embodiment of the present invention is an aluminum ball having a substantially spherical shape, a satisfactory electrostatic property, and rebound resilience.

The cleaning medium 1 is desired to have a diameter that is no greater than ⅕ of the diameter of the opening parts 11, 12 for allowing the cleaning medium 1 to be smoothly introduced into the opening part 11 and smoothly discharged from the opening part 12. More preferably, the cleaning medium 1 is desired to have a diameter that is no greater than 1/10 of the diameter of the opening parts 11, 12 (It is found that a granular material having a diameter greater than ⅕ of the diameter of the opening parts 11, 12 is difficult to introduce and discharge). In this embodiment of the present invention, the aluminum ball, serving as the cleaning medium 1, has a diameter of approximately 2 mm. The angle of repose of the cleaning medium 1 is no greater than the angle of the taper formed at the inner sides of the end planes of the toner supply container 10. From the aspect of safety factor, it is more preferable for the angle of repose of the cleaning medium 1 to be half of the angle of the taper. The aluminum ball in this example has an angle of repose of approximately 5 degrees. It is to be noted that the angle of repose refers to one of the property values of a granular material, which is the minimum angle of inclination that causes the granular material to slide from a slope.

In Procedure (I), a sufficient amount of the cleaning medium 1 is supplied into the hopper 21 and maintained inside the hopper 21 by closing the valve 22 so as to prevent the cleaning medium 22 from flowing down into the toner supply container 10.

Then, the toner supply container 10 is mounted onto the container holding mechanism 26 of the cleaning apparatus 20 (Procedure (II)). The toner supply container 10 is mounted in a manner so that the opening part 11 is facing upward and the opening part 12 is facing downward. Normally, the toner supply container 10 has each of the opening parts 11, 12 sealed with a cap, for example, when in an unused state.

Then, after the caps are removed from the opening parts 11, 12, the pipes 23, 27 are connected to the corresponding opening parts 11, 12. In a case where the connecting parts 17, 18 are provided at the peripheries of the opening parts 11, 12, the pipes 23, 27 are connected to the opening parts 11, 12 via the connecting parts 17, 18 (Procedure (III)).

The valve 22 is opened (Procedure (IV)). This allows the cleaning medium 1 maintained in the hopper 21 to flow down into the toner supply container 10 via the pipe 23. In this example, the opening of the valve 22 is adjusted to allow the cleaning medium 1 to flow at a rate of 1.4 liters/minute. The cleaning medium 1 flowing into the toner supply container 10 from the opening part 11 collides with the flow control member 13. The shape and position of the flow control member 13 determines the flow of the cleaning medium 1 inside the toner supply container 10. The flow of the cleaning medium 1 serves to remove the residual stain (toner) on the inner wall of the toner supply container 10.

Figure 6:
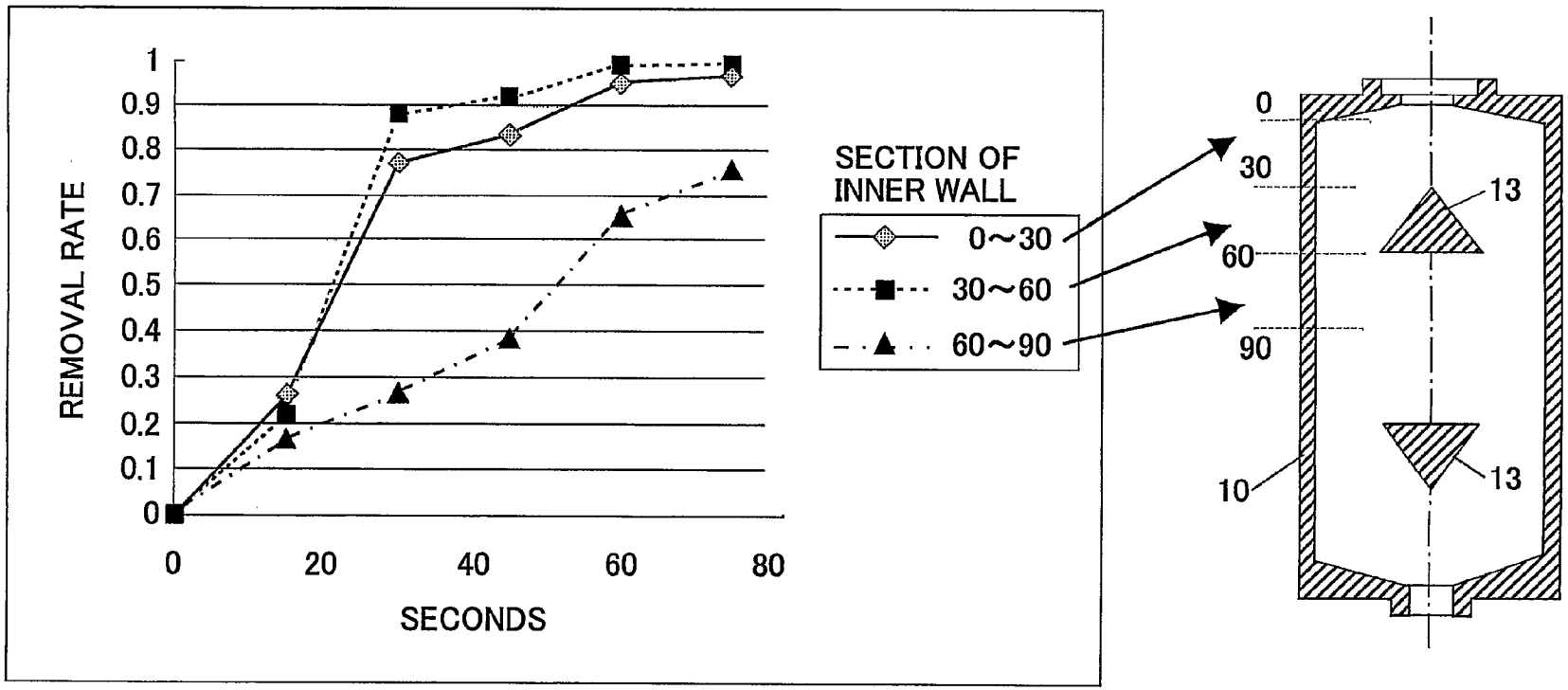
FIG. 6 is a graph for describing changes of toner removal rates in different sections of the toner supply container in relation with the elapsing of time in a case of cleaning the toner supply container with the cleaning apparatus according to the first embodiment of the present invention.

FIG. 6 shows the cleaning results (toner removal rate) measured in Procedure (IV) in relation to the elapsed time. In this example, the toner removal rate is measured with respect to three sections (divided at intervals of 30 mm beginning from the top inner plane of the toner supply container 10) of the inner wall of the toner supply container 10. In this example, the base plane of the flow control member 13 (base of triangle pole) is located at a height that is 60 mm apart from the top inner plane of the toner supply container 10. Accordingly, as shown in FIG. 6, for the area above the flow control member 13, the residual toner stain can be substantially completely removed (removal rate 1.0) after approximately 60 seconds elapses after the start of Procedure (IV).

If desired, additional kinetic energy may be applied to the cleaning medium 1 while the cleaning medium 1 is flowing inside the toner supply container 10 (Procedure (V)). In this example, vibration is applied to the toner supply container 10 by a shaking member (not shown). The applying of kinetic energy is not limited to the form of using a shaking member. For example, a shock generating member for applying shock to the toner supply container 10 may alternatively used. By applying vibration or shock from outside of the toner supply container 10, kinetic energy is transmitted to the cleaning member 1. This prevents bridging of the cleaning member 1 and enables smooth flow of the cleaning member 1. Furthermore, cleaning performance increases as the kinetic energy applied to the cleaning medium 1 increases.

As the cleaning medium 1 reaches the bottom inner plane of the toner supply container 10, the cleaning medium 1 is guided to the opening part 12 by the tapered area surrounding the opening part 12 and is discharged from the toner supply container 10. The discharged cleaning medium 1 passes through the pipe 27 to be stored in the cleaning medium container 28. Then, the cleaning medium 11 stored in the cleaning medium container 28 is passed through the carrier pipe 31 to be delivered into the cleaning medium recycling mechanism 32. Inside the cleaning medium recycling mechanism 32, the toner attached to the cleaning medium 1 is separated from the cleaning medium 1.

Then, the valve 22 is closed and the supplying of the cleaning medium 1 into the toner supply container 10 is stopped. In this state, the toner supply container 10 is left to stand until substantially all of the cleaning medium 1 in the toner supply container 10 is discharged from the toner supply container 10 (Procedure (VI)).

Then, the toner supply container 10 is detached from the cleaning apparatus 20 (Procedure (VII)).

If desired, the toner supply container 10 may be flipped upside down and the above-described Procedures (II) to (VII) may be repeated (Procedure (VIII)). Since gravity accelerates the cleaning medium 1, the toner removing effect of the cleaning medium 1 may be greater at the inner walls of the lower portion of the toner supply container 10 compared to the inner walls of the upper portion of the toner supply container 10. Accordingly, by flipping the toner supply container 10 upside down and repeating Procedures (II)-(VII), toner can be removed in a shorter amount of time.

By performing the Procedures (I) to (VIII), the inside of the toner supply container 10 can be cleaned. In this example, the cleaning method of the present invention is manually performed by the user until Procedure (II), and the procedures such as opening/closing the valve 22 or switching on/off of the vibration applied to the toner supply container 10 are performed automatically by using a timer, for example.

Next, the cleaning method of the present invention is compared to a conventional method shown in Japanese Laid-Open Patent Application No. 2002-268383. The conventional method uses the rotation of a magnetic plate provided outside of a container for accelerating movement of the cleaning medium inside the container. The procedures of the conventional method are as follows.

Procedure (1): Supply cleaning medium to hopper.
Procedure (2): Mount container to cleaning apparatus.
Procedure (3): Connect opening part of container to hopper.
Procedure (4): Introduce cleaning medium from hopper to container.
Procedure (5): Accelerate magnetic plate until cleaning medium reaches necessary cleaning movement speed.
Procedure (6): Clean inside of container by maintaining necessary cleaning movement speed.
Procedure (7): Decelerate magnetic plate.
Procedure (8): Connect opening part of container to discharge pipe.
Procedure (9): Discharge cleaning medium.
···Repeat Procedures (3) to (9) until reaching target cleaning degree (target cleaning state).
Procedure (10): Detach container from cleaning apparatus.

Figure 7:
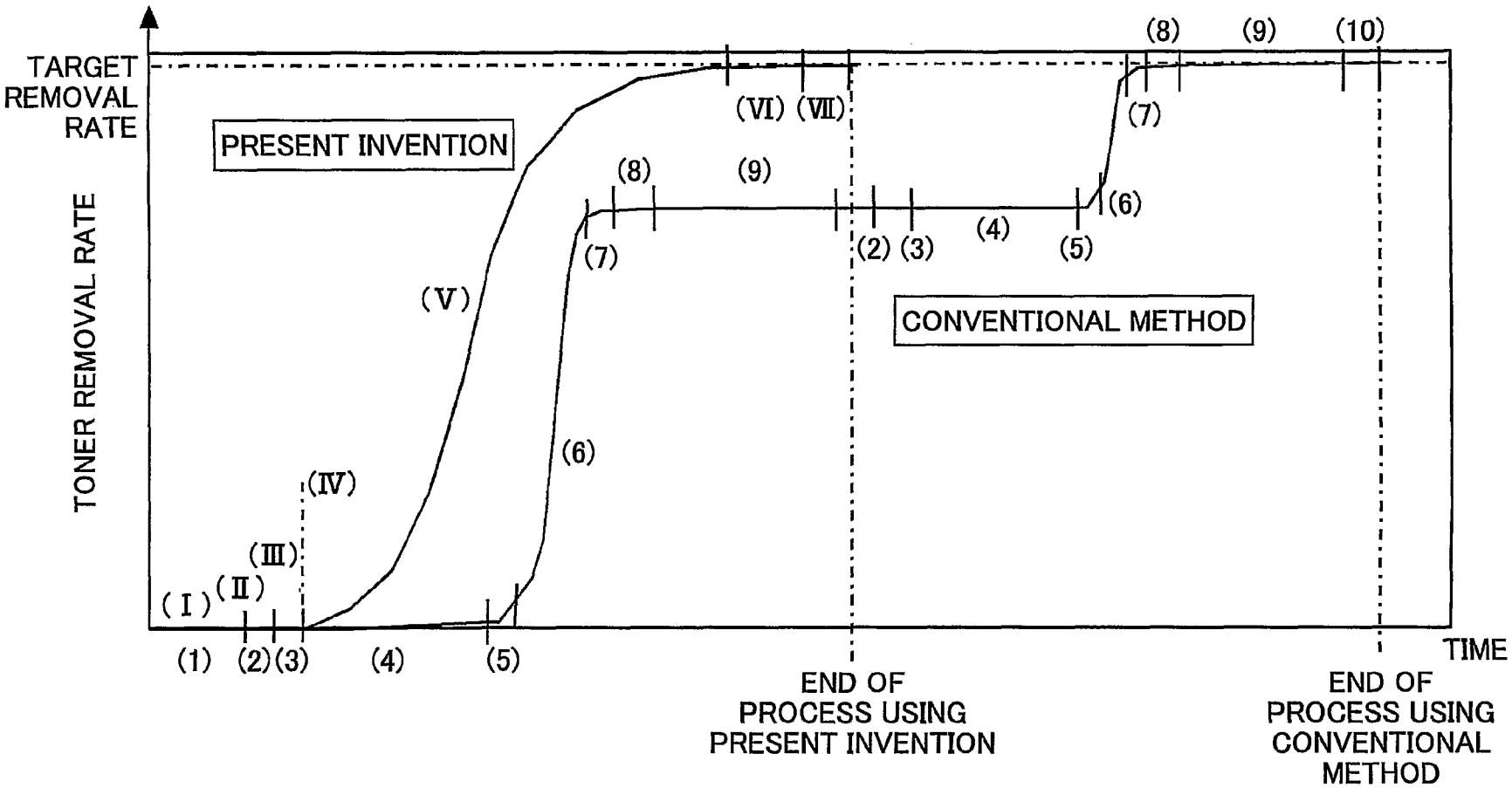
FIG. 7 is a graph for comparing the procedures of the cleaning method according to the first embodiment of the present invention and the procedures of a conventional cleaning method.

In the conventional method, Procedures (5) through (7) correspond to the procedures for actually moving the cleaning medium and enabling the cleaning medium to remove the residual stain in the container. On the other hand, Procedures (IV) and (V) correspond to the procedures for removing the residual stain in the container. As shown in FIG. 7, the conventional method uses a large portion of its time on performing preparative procedures (e.g. Procedure (4)) rather than performing the actual cleaning procedures (Procedures (5)-(7)). Particularly, the conventional method requires a considerable amount of time for introducing a predetermined amount of the cleaning medium in Procedure (4) and for discharging the cleaning medium in Procedure (9). Furthermore, the cleaning medium of the conventional method has an upper limit for the permissible amount of residual stain (toner) attached thereto, and is required to be replaced at least once. Therefore, the conventional method requires an additional procedure of replacing the cleaning medium each time the process of the conventional method is performed.

In the cleaning method of the present invention, the time used in the performing preparative procedures is a small portion with respect to the overall time required for the cleaning method. Therefore, the cleaning method of the present invention can be performed more efficiently. Furthermore, since a new supply of the cleaning medium 1 can be consecutively introduced into the toner supply container 10, there is no upper limit for the permissible amount of residual stain (toner) attached thereto. Accordingly, cleaning can be achieved with fewer procedures by the cleaning method of the present invention than by the conventional method.

Second Embodiment

Figure 8B:
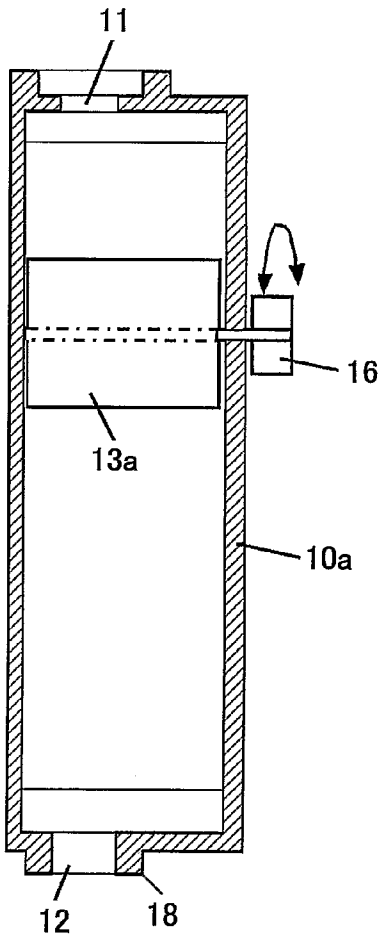
FIG. 8B is a cross-sectional side view of a toner supply container including a flow control member according to a second embodiment of the present invention.
Figure 8A:
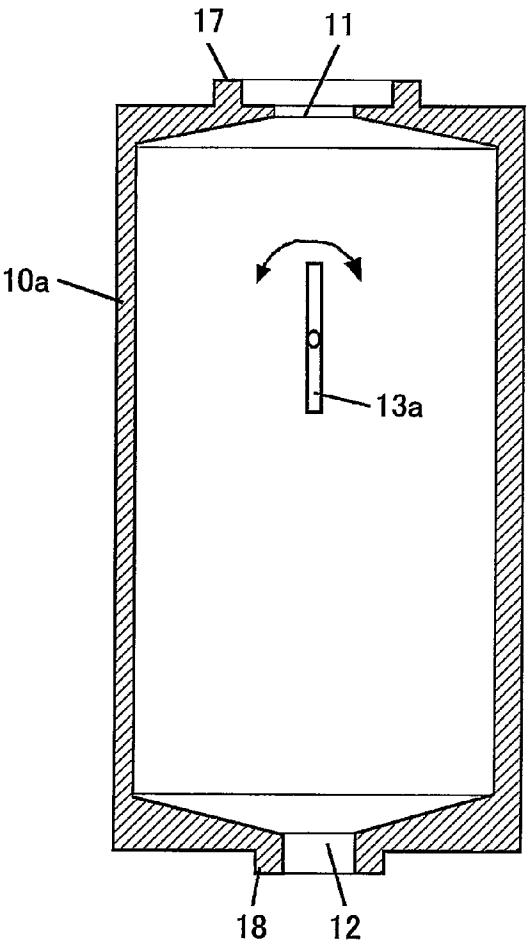
FIG. 8A is a cross-sectional front view of a toner supply container including a flow control member according to a second embodiment of the present invention.
Figure 9A:
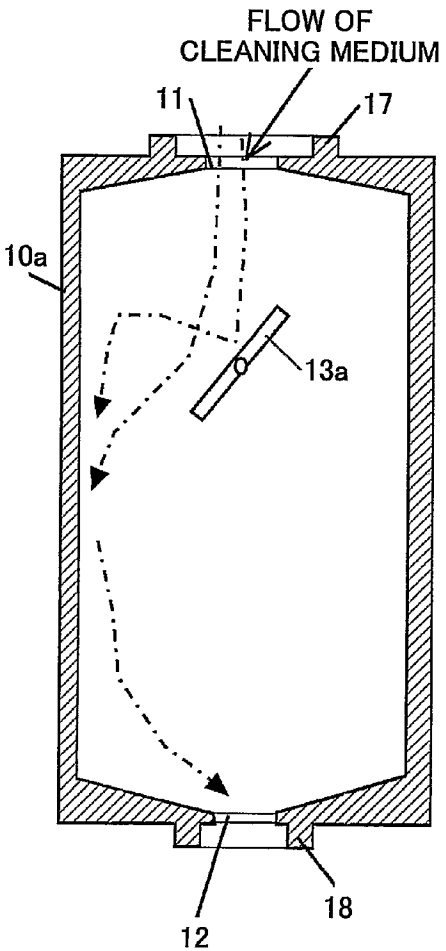
FIG. 9A is a drawing for describing a cleaning operation (movement) of the toner supply container according to the second embodiment of the present invention in a case where the flow control member is tilted rightward.
Figure 9B:
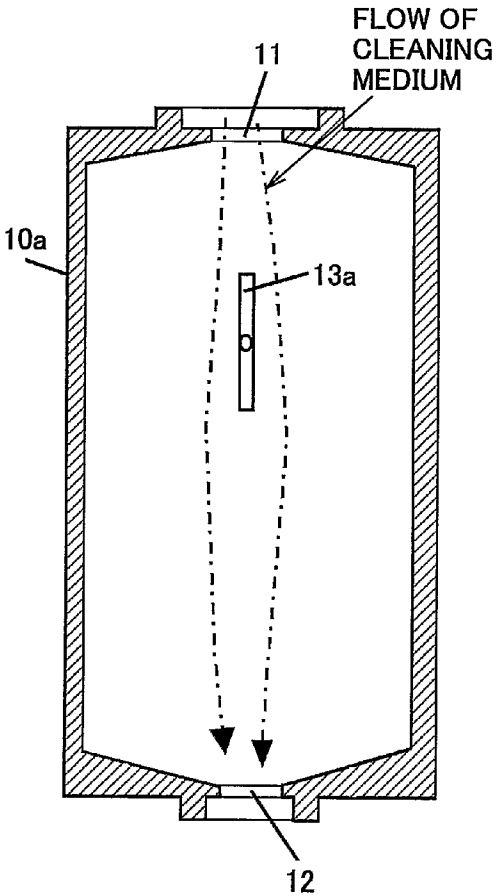
FIG. 9B is a drawing for describing a cleaning operation (movement) of the toner supply container according to the second embodiment of the present invention in a case where the flow control member is not tilted.
Figure 9C:
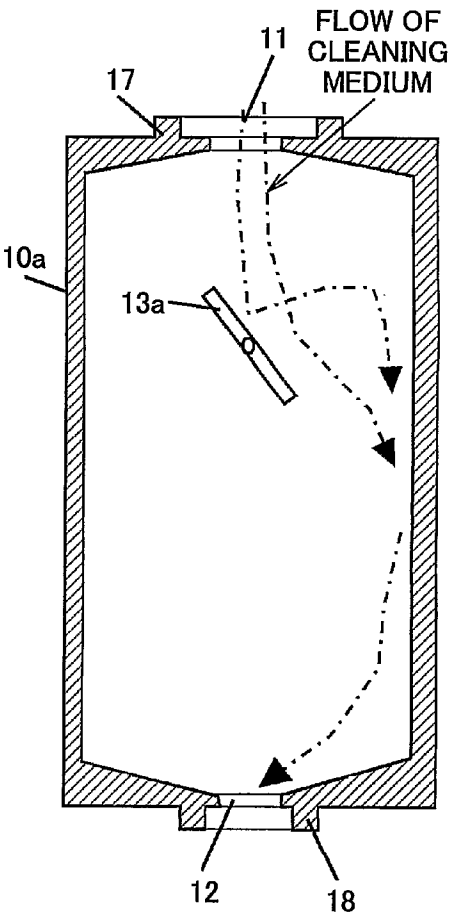
FIG. 9C is a drawing for describing a cleaning operation (movement) of the toner supply container according to the second embodiment of the present invention in a case where the flow control member is tilted leftward.

The second embodiment of the present invention is described with reference to FIGS. 8A-10B. FIGS. 8A and 8B are drawings for describing a toner supply container 10*a* including a flow control member 13*a* according to the second embodiment of the present invention. FIGS. 9A-9C are drawings for describing the cleaning operation (cleaning movement) inside the toner supply container 10*a* with the flow control member 13*a* according to the second embodiment of the present invention. FIGS. 1A and 10B are drawings for describing a cleaning apparatus 20*a* for cleaning the toner supply container 10*a* including the flow control member 13*a*.

With reference to FIGS. 8A and 8B, the angle (inclination) of the flow control member 13*a* provided in the toner supply container 10*a* can be freely adjusted (controlled). The flow control member 13*a* is formed as a rotatable panel situated between the opening part 11 and the opening part 12. The flow control member 13*a* can be controlled by, for example, a gear 16 provided outside of the toner supply container 10*a*.

Next, the inclination of the panel-shaped flow control member 13*a* and the operation (movement) of the cleaning process is described with reference to FIGS. 9A-9C. In FIG. 9A, a large portion of the cleaning medium 1 is deflected to the left side of the toner supply container 10*a* by tilting the flow control member 13*a* approximately 30-45 degrees rightward (clockwise). The deflected cleaning medium 1 flows down along the inner wall on the left side of the toner supply container 10*a* and attaches (attracts) the residual stain (toner) remaining on the inner wall. Accordingly, the inner wall on the left side of the toner supply container 10*a* can be cleaned. In FIG. 9B, by positioning the flow control member 13*a* in an upright (vertical) manner, the cleaning medium 1 falls substantially vertically downward and cleans the flow control member 13*a* while falling. In FIG. 9C, by tilting the flow control member 13*a* in the opposite direction from FIG. 9A (i.e. leftward), a large portion of the cleaning medium 1 is deflected to the right side of the toner supply container 10*a*. The deflected cleaning medium 1 flows down along the inner wall on the right side of the toner supply container 10*a* and attaches (attracts) the residual stain (toner) remaining on the inner wall. Accordingly, the inner wall on the right side of the toner supply container 10*a* can be cleaned. By using the tilting movement of the panel-shaped flow control member 13*a*, the inside of the toner supply container 10*a* can be substantially entirely cleaned.

After the cleaning process of the toner supply container 10*a* is completed, it is preferable to position the flow control member 13*a* in an upright manner (as shown in FIG. 9B) when injecting new toner into the toner supply container 10*a*. This allows the new toner to be smoothly introduced into the toner supply container 10*a* without the flow control member 13*a* obstructing the injection of the toner.

More specifically, the control of the angle of the flow control member 13*a* is performed by switching the position of the flow control member 13*a* on a time basis. That is, in a prepatory stage for designing the cleaning process, cleaning levels (cleaning performances) in predetermined areas of the toner supply container 10*a* are recorded in correspondence with each angle. This makes it possible to determine the areas which are easy or difficult to clean in relation with the angle of the flow control member 13*a*. The various cleaning levels are combined and complemented, to thereby obtain a suitable combination of angles of the flow control member 13*a* for cleaning the entire inside of the toner supply container 10*a*.

In the actual cleaning process, while the cleaning medium 1 continues to fall and flow inside the toner supply container 10*a*, the flow control member 13*a* is set to maintain various angles for various predetermined periods of time in accordance with the control of a timer. Accordingly, the entire inside of the toner supply container 10*a* can be cleaned.

Figure 10A:
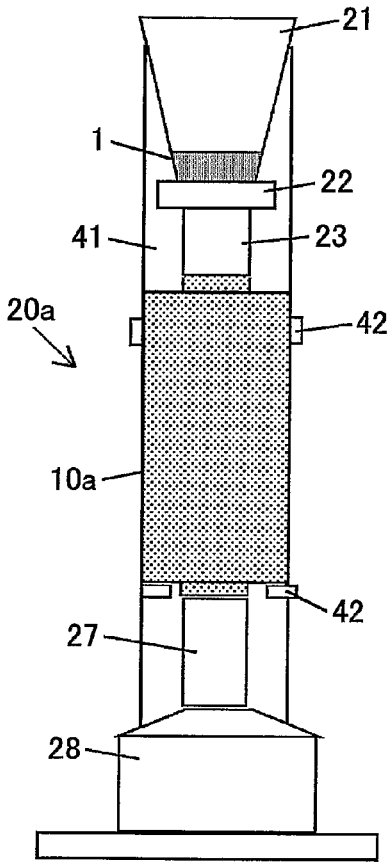
FIG. 10A is a schematic front view of a cleaning apparatus for the toner supply container according to the second embodiment of the present invention.
Figure 10B:
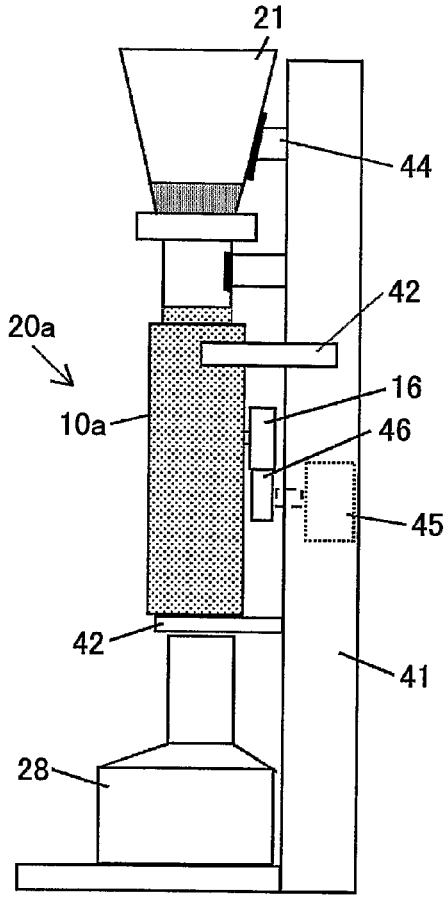
FIG. 10B is a schematic side view of a cleaning apparatus for the toner supply container according to the second embodiment of the present invention.

FIGS. 10A and 10B are drawings showing an example of the cleaning apparatus 20*a* used for cleaning the toner supply container 10*a* shown in FIGS. 8A and 8B. The basic configuration of the cleaning apparatus 20*a* is the same as the cleaning apparatus 20 of the first embodiment of the present invention (see FIGS. 5A and 5B), in which the cleaning apparatus 20*a* includes, for example, the hopper 21 for containing the cleaning medium 1, and the valve 22, and the pipe 23 for guiding the cleaning medium 1 into the toner supply container 10*a*. The cleaning apparatus 20*a* also includes a supporting claw member 42 for setting the toner supply container 10*a* in a fixed position, and a gear 46 situated at a position for engaging with the gear 16 for driving the flow control member 13*a* in the toner supply container 10*a*. The gear 46 of the cleaning apparatus 20*a* is driven by a motor 45 installed inside a column 41.

The torque of the motor 45 is no less than the impact force created by the collision of the cleaning medium 1 with the flow control member 13*a*, and has sufficient holding power against the collision. That is, the motor 45 and the gear 46 serve as a driving mechanism as well as a holding mechanism. The motor 45 moves the flow control member 13*a* to a predetermined angle in accordance with the control of the timer. Accordingly, the cleaning medium 1 collides with the flow control member 13*a* and is deflected by the flow control member 13*a*, to thereby collide with the entire inner wall of the toner supply container 10*a*. As a result, the residual stains remaining on the inner walls of the toner supply container 10*a* are removed and the inside of the toner supply container 10*a* is cleaned.

Third Embodiment

Figure 11C:
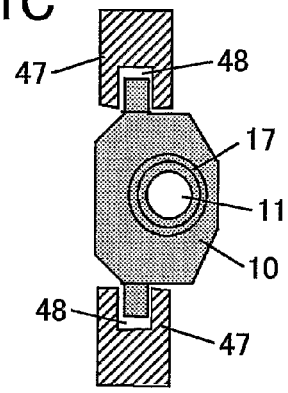
FIG. 11C is a plan view of a container holding mechanism capable of holding multiple toner supply containers for a cleaning apparatus according to a third embodiment of the present invention.
Figure 11C:
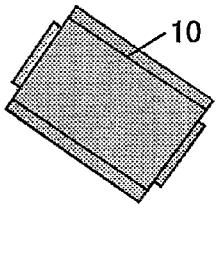
Figure 11A:
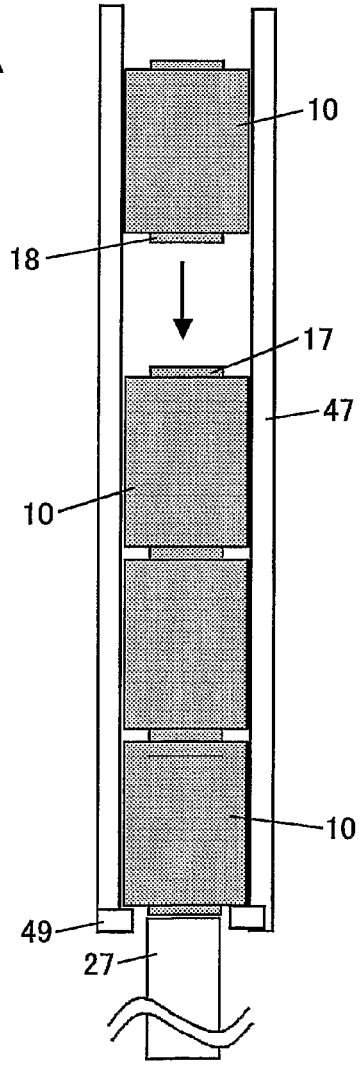
FIG. 11A is a front view of a container holding mechanism capable of holding multiple toner supply containers for a cleaning apparatus according to a third embodiment of the present invention.
Figure 11B:
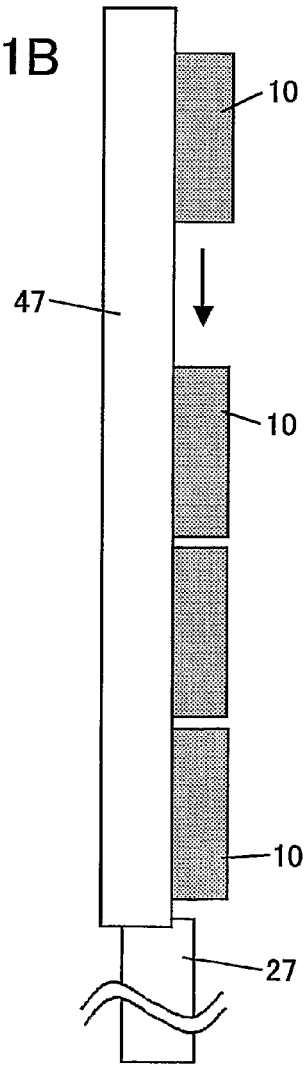
FIG. 11B is a side view of a container holding mechanism capable of holding multiple toner supply containers for a cleaning apparatus according to a third embodiment of the present invention.
Figure 12:
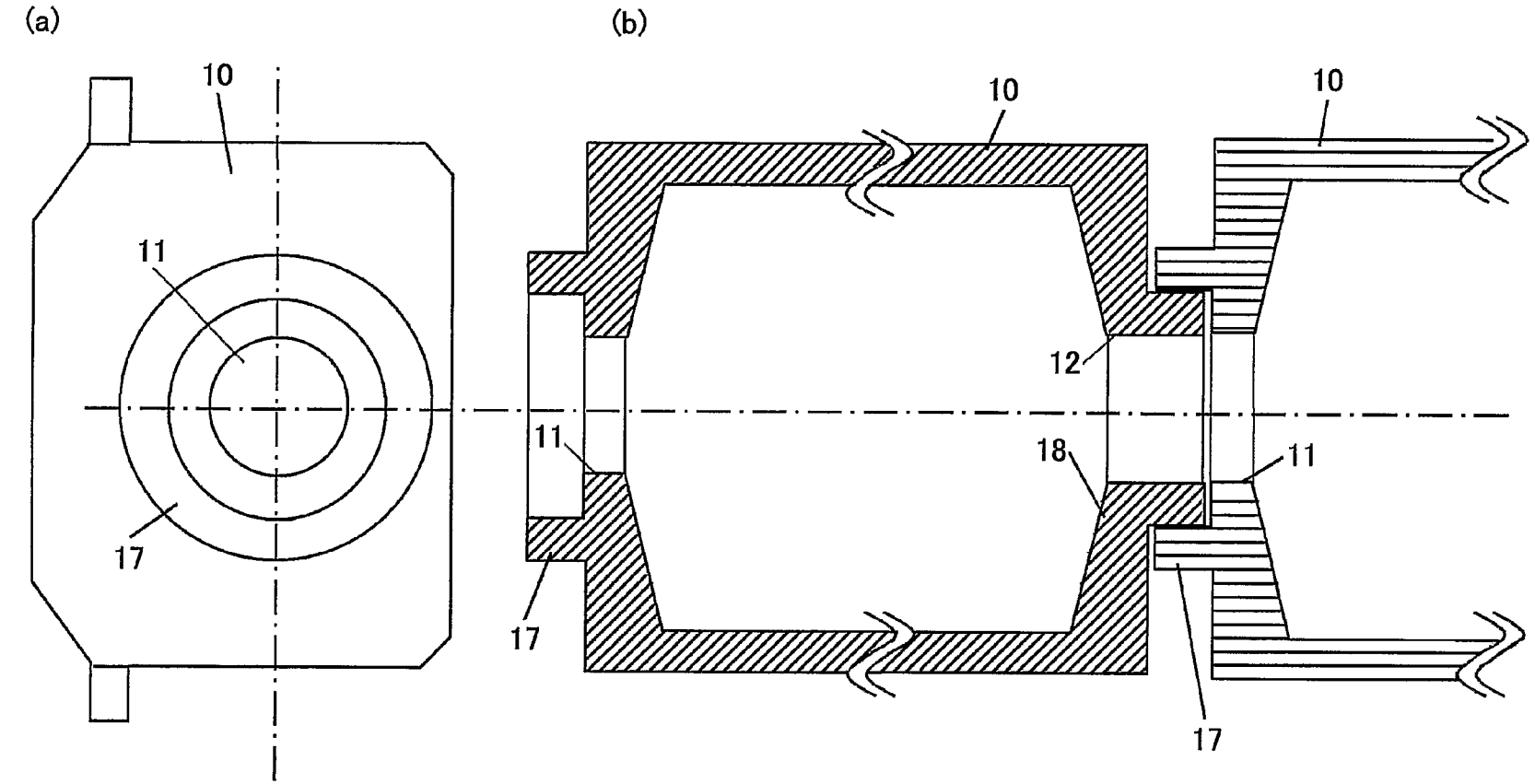
FIG. 12 is a drawing for describing connection of toner supply containers with the container holding mechanism according to the third embodiment of the present invention, in which (a) is a plan view of one of the toner containers, and (b) is a cross-sectional side view of the toner containers.
Figure 13:
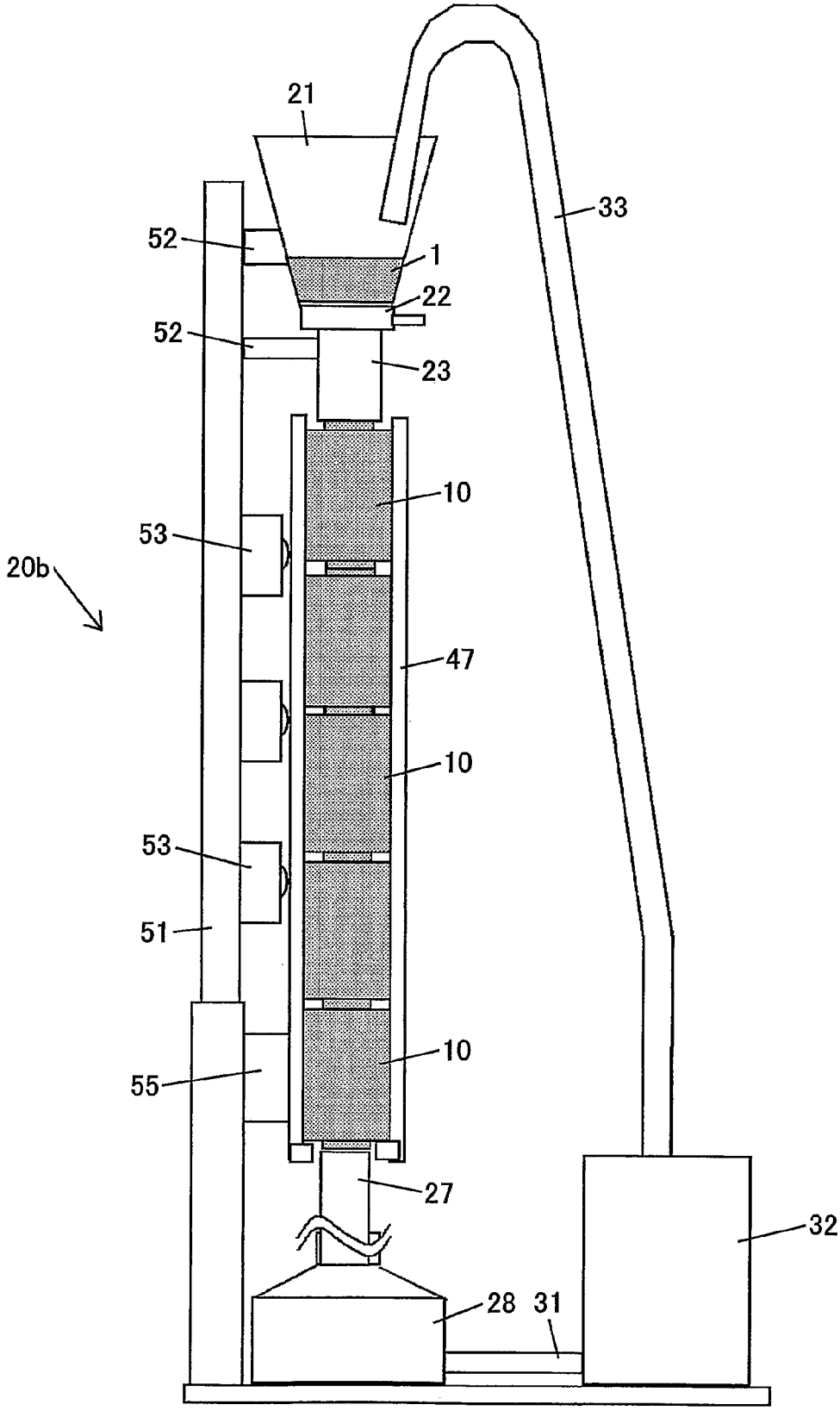
FIG. 13 is a drawing for describing a cleaning apparatus having the container holding mechanism according to the third embodiment of the present invention.

The third embodiment of the present invention is described with reference to FIGS. 11A-13. FIGS. 11A-11C are drawings for describing a container holding mechanism 55 of a cleaning apparatus 20*b* holding multiple toner supply containers 10 according to the third embodiment of the present invention. FIGS. 12A and 12B are drawings for describing a connection between one toner supply container 10 and another toner supply container 10. FIG. 13 is a drawing for describing a cleaning apparatus 20*b* provided with multiple connected toner supply containers 10.

As shown in FIGS. 11A-11C and FIGS. 12A-12B, the toner supply container 10 includes the connecting parts 17, 18 provided at opening parts 11, 12, respectively, on the opposite ends of the toner supply container 10. In this example, the inner diameter of the connecting part 17 and the outer diameter of the connecting part 18 are configured to be equal. This allows the connecting part 17 to engage with the connecting part 18. Accordingly, the opening part 11 and the opening part 12 can be firmly engaged with each other. In another example, the connecting part 17 and the connecting part 18 may alternatively be configured to be the same size, and one of the opening parts 11, 12 may be provided with a concave part and the other one of the opening parts 11, 12 may be provided with a convex part. This also allows the opening part 11 and the opening part 12 to be firmly engaged with each other.

It is to be noted that neither the size and shape of the opening parts 11, 12 nor the size and shape of the connecting parts 17, 18 are limited to the above-described example as long as the function of connecting the opening parts 11, 12 can be attained.

As shown in FIG. 11A-11C, multiple toner supply containers 10 are connected at the opening parts 11, 12. By setting multiple toner supply containers $\mathbf{10}_1, \mathbf{10}_2, \ldots \mathbf{10}_n$ in an upright position, the insides of the multiple toner supply containers $\mathbf{10}_1, \mathbf{10}_2, \ldots \mathbf{10}_n$ can be cleaned at the same time. By using this method, not only can the insides be cleaned at the same time but also a shorter cleaning process can be achieved. Furthermore, since the residual stain can be removed more efficiently as the flowing distance of the cleaning medium 1 increases, more residual stain can be collected compared to a case where the cleaning medium 1 flows for a shorter distance. Therefore, the amount of the cleaning medium 1 can be reduced. The same effect can be attained in a case where the cleaning medium 1 flows down the multiple toner supply containers 10 positioned in an inclined manner.

As shown in FIG. 13, the cleaning apparatus 20*b* of the third embodiment of the present invention is provided with the container holding mechanism 55 including a container guide 47 for holding the multiple toner supply containers 10 and matching the positions of the toner supply containers 10. Furthermore, the cleaning apparatus 20*b* includes vibration units 53 mounted onto the container guide 47. The vibration units 53 have a function of constantly applying vibration to the toner supply containers 10 for enabling the cleaning medium 1 to flow smoothly in the toner supply containers 10.

Next, operating procedures of the cleaning apparatus 20*b* of the third embodiment of the present invention are described. In this example, the user mounts the toner supply container(s) 10 onto the cleaning apparatus 20*b* from an upper part of the container guide 47 of the container holding mechanism 55 (See FIG. 11A) for allowing the toner supply container 10 to slide downward along the container guide 47. The positions of the toner supply containers 10 are automatically matched by the container guide 47, such that one of the opening parts 11, 12 is connected to the other one of the opening parts 12, 11 via the connecting parts 17, 18. After all of the toner supply containers $\mathbf{10}_1, \mathbf{10}_2, \ldots \mathbf{10}_n$ are connected, the hopper 21 and the pipe 27 situated below the valve 22 are connected to the connecting part 17 of the uppermost toner supply container 10 (see FIG. 13). The procedures following this connection are the same as the procedures in the cleaning process of the first embodiment of the present invention (procedures starting from Procedure (IV) and thereafter). After the cleaning procedure is finished and the cleaning medium 1 is discharged from the toner supply containers 10, the connected state of the toner supply containers $\mathbf{10}_1, \mathbf{10}_2, \ldots \mathbf{10}_n$ is released, and the toner supply containers $\mathbf{10}_1, \mathbf{10}_2, \ldots \mathbf{10}_n$ are removed one by one from the cleaning apparatus 20*b*. With the cleaning process according to the third embodiment of the present invention, multiple toner supply containers $\mathbf{10}_1, \mathbf{10}_2, \ldots \mathbf{10}_n$ can be cleaned in a batch.

Fourth Embodiment

Figure 14:
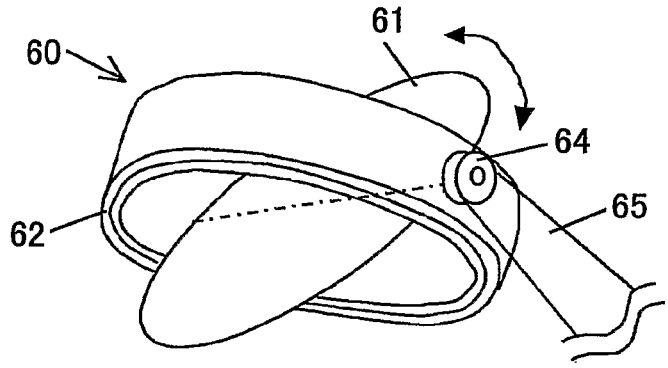
FIG. 14 is a connecting part for connecting a toner supply container according to the fourth embodiment of the present invention.
Figure 15:
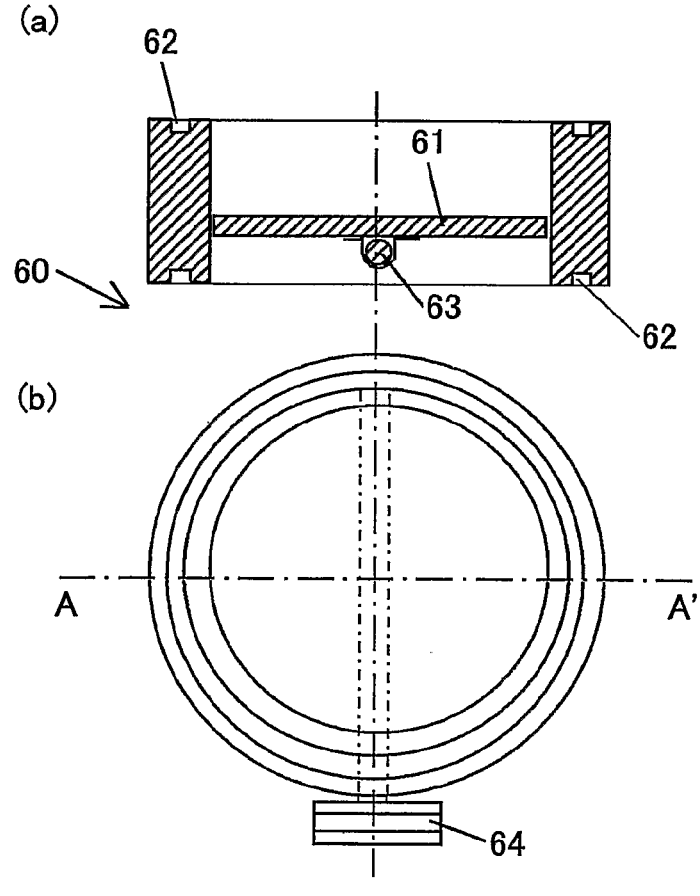
FIG. 15 is a schematic view of a connecting part according to the fourth embodiment of the present invention, in which (a) is a cross-sectional view of the connecting part taken along line A-A' of (b), and (b) is a plan view of the connecting part shown in (a)
Figure 16:
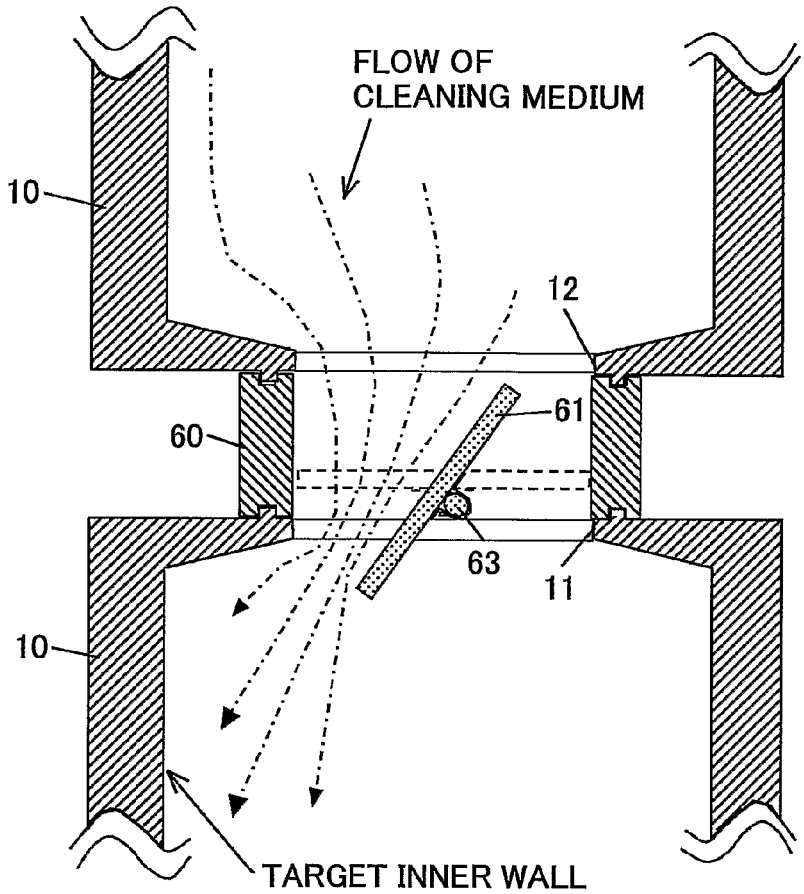
FIG. 16 is a drawing for describing operation (movement) in a case where toner supply containers are connected with the connecting parts according to the fourth embodiment of the present invention.

The fourth embodiment of the present invention is described with reference to FIGS. 14-16. FIGS. 14 and 15 are drawings for describing a configuration of a connecting part 60 for connecting the toner supply containers 10 according to the fourth embodiment of the present invention. FIG. 16 is a drawing for describing a function of the connecting part 60 for connecting the toner supply containers 10.

Similar to the third embodiment of the present invention, the fourth embodiment of the present invention also connects multiple toner supply containers 10 and cleans multiple toner supply containers 10 in a batch. However, in the fourth embodiment of the present invention, the multiple toner supply containers 10 are not directly connected to each other. More specifically, the adjacent multiple toner supply containers 10 are connected by an annular connecting part 60 which is used as a spacer.

The connecting part 60 is provided with a mating part of either a groove(s) or a protrusion(s) (in this example, a groove) 62 for mating with a corresponding mating part provided on the opening part 11, 12 of the toner supply container 10. Although the mating parts used in this example are a groove and a protrusion, the opening parts 11, 12 of the toner supply containers 10 may be mated with the connecting part 60 in other forms of mating parts as long as the cleaning medium 1 can be smoothly guided through the opening parts 11, 12 of the toner supply container 10.

The connecting part 60 also includes a flow control valve plate 61 which rotatably interlocks with a gear 64 provided outside of the connecting part 60, as shown in FIGS. 14 and 15. The gear 64 is controlled by a driving part of the cleaning apparatus 20 via a toothed belt 65. In this example, the flow control valve plate 61 is rotated for a predetermined time period.

The operation of the connecting part 60 of the fourth embodiment of the present invention is described with reference to FIG. 16. Other than the procedure of connecting the toner supply containers 10 with the connecting parts 60, the procedures in the cleaning process according to the fourth embodiment of the present invention are the same as those of the third embodiment of the present invention. The flow of the cleaning medium 1 can be controlled by rotating the flow control valve plate 61 so as to increase the amount of cleaning medium 1 applied to a particular area of the inner wall of the toner supply container 10 for cleaning the particular area. Furthermore, by rotating the flow control valve plate 61 for uniform periods of time (intervals), the entire inner wall of the toner supply container 10 can be uniformly cleaned. The cleaning procedures of the fourth embodiment of the present invention are substantially the same as those of the first embodiment of the present invention.

Fifth Embodiment

Figure 17A:
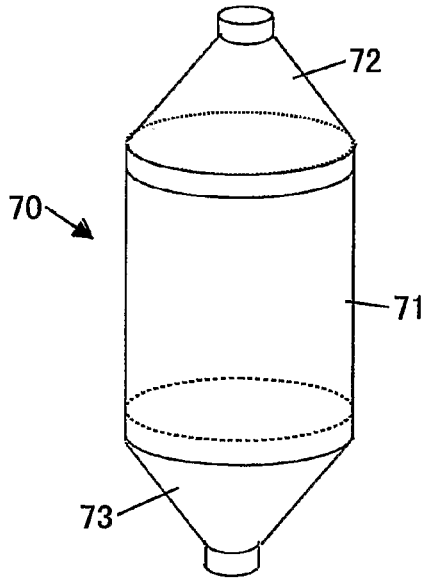
FIG. 17A is a perspective view of a toner bottle including upper and lower bottle caps and a bottle main body according to the fifth embodiment of the present invention.
Figure 17B:
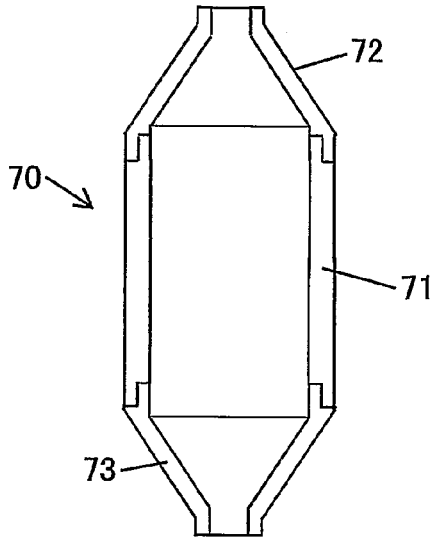
FIG. 17B is a cross-sectional view of a toner bottle including upper and lower bottle caps and a bottle main body according to the fifth embodiment of the present invention.

The fifth embodiment of the present invention is described with reference to FIGS. 17-19B. FIGS. 17A and 17B are drawings for describing a toner bottle (powder container) 70 according to the fifth embodiment of the present invention. FIGS. 18A-18C and FIGS. 19A-19B are drawings for describing various cleaning apparatuses 80*a*-80*d* for cleaning bottle caps 72, 73 and bottle main bodies 71 according to the fifth embodiment of the present invention.

In the fifth embodiment of the present invention, the toner bottles 70, each having an axisymmetric shape, are cleaned in a manner where the toner bottles 70 are disassembled and joined together.

FIGS. 17A and 17B are schematic views of the toner bottle 70 comprising upper and lower bottle caps 72, 73 and the bottle main body 71. The toner bottle 70 can be disassembled into three components including the upper bottle cap 72, the lower bottle cap 73, and the bottle main body 71.

The joint parts of the components are mating types which can hermetically join together. This prevents toner powder from spilling from the toner bottle 70. The diameters and the connecting methods of the joint parts are uniform.

In the toner bottle 70, the main body 71 has a cylindrical shape. The upper and lower bottle caps 72, 73 have circular conical shapes.

Figure 18C:
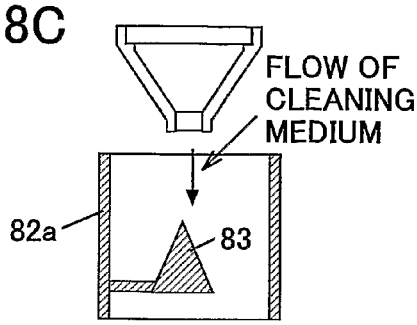
FIGS. 18A-18C are schematic views for describing a cleaning apparatus for cleaning toner bottles according to the fifth embodiment of the present invention.
Figure 18A:
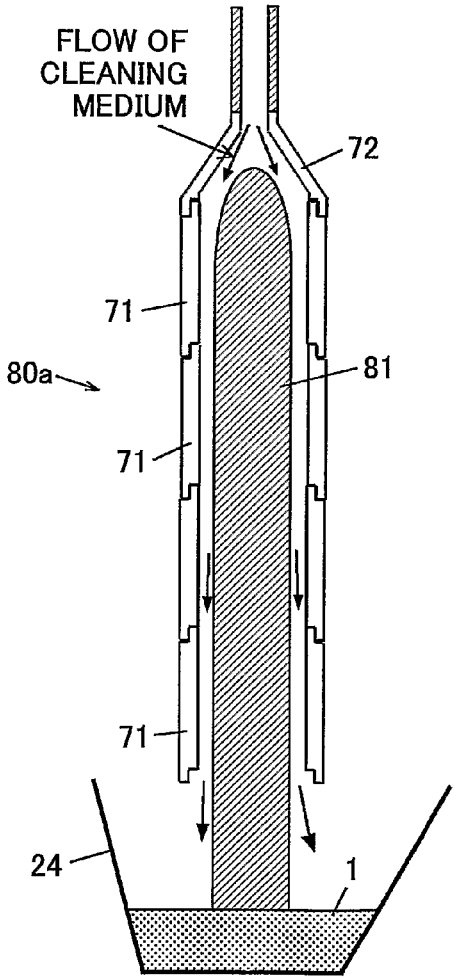
Figure 18B:
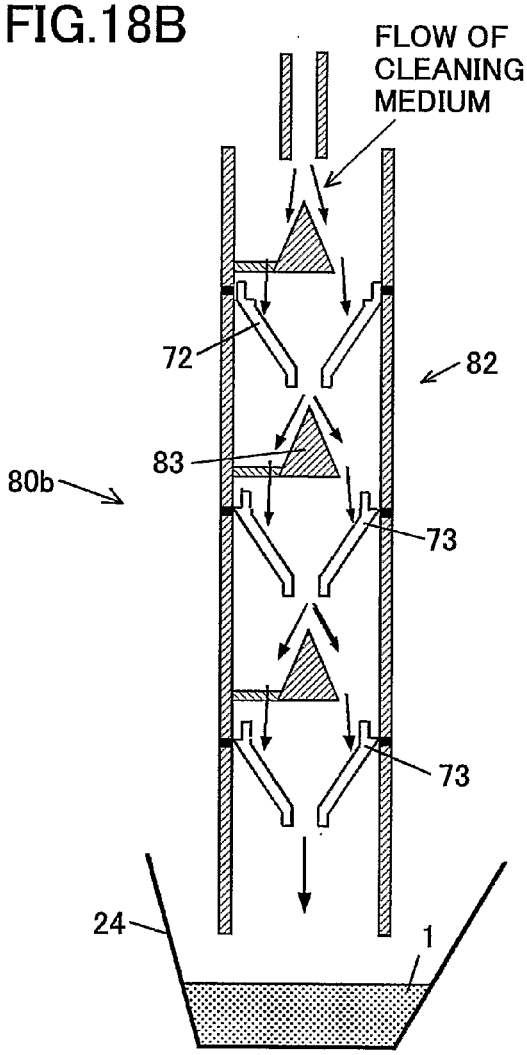

FIGS. 18A and 18B show cleaning apparatuses 80*a*, 80*b* for cleaning the toner bottles 70 according to the fifth embodiment of the present invention.

First, multiple toner bottles 70 are disassembled and the bottle main bodies 71 thereof are multiply mounted in a connected manner. Then, one upper bottle cap 72 is mounted on the uppermost portion of the connected main bodies 71, as shown in FIG. 18A. Although not shown in FIG. 18A, the multiply connected bottle main bodies 71 are retained and fixed by a retaining part without abutting a flow control part 81 fixed to a cleaning medium receptacle 24 of the cleaning apparatus 80*a*. The flow control part 81 is configured as a rod which is inserted into the connected main bodies 71 and occupies a large portion of the inner volume of the bottle main bodies 71.

Furthermore, the flow control part 81 has a solid body having a property of sufficiently deflecting the cleaning medium 1 (elastic rebound property). Accordingly, by allowing the cleaning medium 1 to flow downward from the opening part of the upper bottle cap 72 against the multiple bottle main bodies 71 and the flow control part 81, the multiple bottle main bodies 71 can be cleaned in a batch.

The conical shaped upper and lower bottle caps 72, 73 separated from the bottle main body 71 are cleaned with another cleaning apparatus 80*b*, as shown in FIG. 18B. The upper and lower bottle caps 72, 73 mounted along a cylindrical guide 82 of the cleaning apparatus 80*b* in a manner that the opening parts of the upper and lower bottle caps 72, 73 are uniformly facing a predetermined direction. Although not shown in FIG. 18B, a mechanism for holding the upper and lower bottle caps 72, 73 in a predetermined space (interval) is provided to an inner side of the guide 82. Furthermore, as shown in FIGS. 18B and 18C, the cylindrical guide 82 can be disassembled so that a single guide unit 82*a* can accommodate a single bottle cap 72, 73. This allows the bottle caps 72, 73 to be easily mounted on the inner side of the guide 82. A flow control part 83 is provided in between the bottle caps 72, 73 for controlling the flow of the cleaning medium 1. Accordingly, by allowing the cleaning medium 1 to flow downward toward the opening parts of the bottle caps 72, 73, the multiple bottle caps 72, 73 can be cleaned in a batch.

Figure 19A:
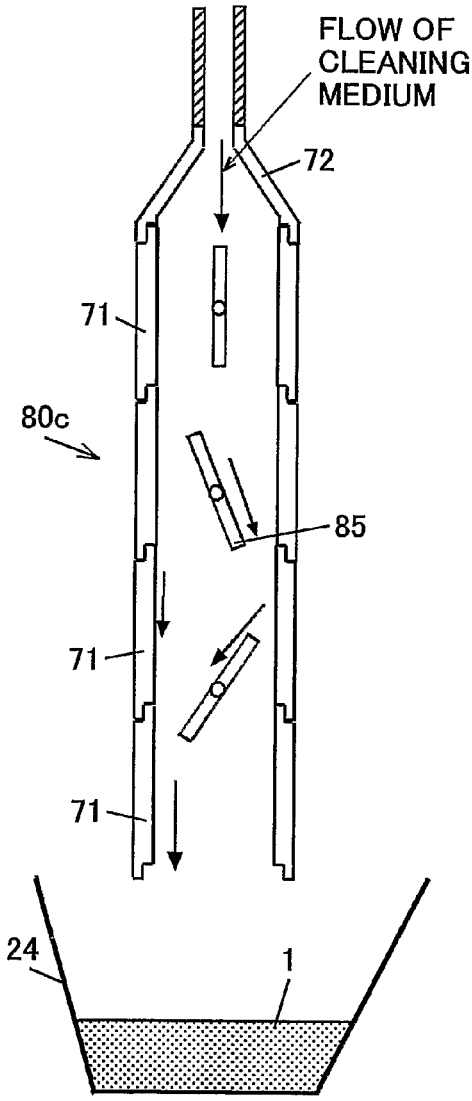
FIGS. 19A-19B are schematic views for describing another cleaning apparatus for cleaning toner bottles according to the fifth embodiment of the present invention.
Figure 19B:
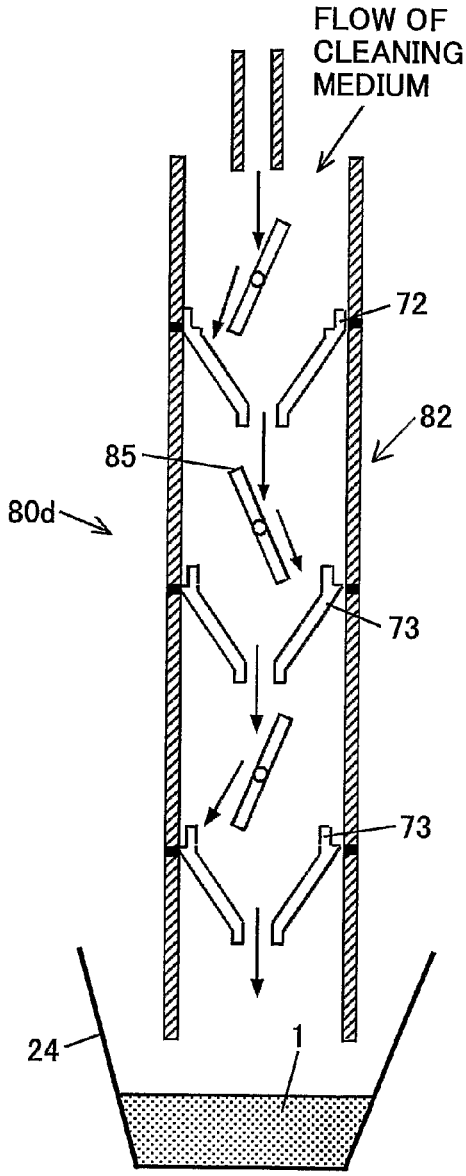

Furthermore, FIG. 19A shows another cleaning apparatus 80*c* for cleaning the bottle main bodies 71, and FIG. 19B shows another cleaning apparatus 80*d* for cleaning the bottle caps 72, 73. The cleaning apparatuses 80*c*, 80*d* are different from the above-described cleaning apparatuses 80*a*, 80*b* in that the flow control parts 81, 83 are replaced by a panel-shaped flow control part 85. Although not shown in FIGS. 19A and 19B, the cleaning apparatuses 80*c*, 80*d* drive the flow control part 85 so that the flow control part 85 rotates in a predetermined manner. By rotating the flow control part 85 in the predetermined manner, the cleaning medium 1 colliding with the flow control part 85 is deflected and dispersed inside the bottle main bodies 71 and the bottle caps 72, 73. This enables sufficient removal of residual stain (powder) remaining inside the toner bottle 70.

Further, the present invention is not limited to these embodiments, but variations and modifications may be made without departing from the scope of the present invention.

The present application is based on Japanese Priority Application No. 2004-240844 filed on Aug. 20, 2004 with the Japanese Patent Office, the entire contents of which are hereby incorporated by reference.

The invention claimed is:

1. A cleaning method for cleaning a powder container, the method comprising:

introducing a cleaning medium having a property to attract the powder by electrostatic force into the powder container from a first opening part of the powder container for attaching powder in the powder container to the cleaning medium, said cleaning medium being an aluminum ball having a substantially spherical shape, an electrostatic property, and a rebound resilience;

discharging the cleaning medium and the powder attracted to the cleaning medium by the electrostatic force from a second opening part situated opposite from the first opening part; and releasing the cleaning medium having the property to attract the powder by the electrostatic force from a position higher than the first opening part of the powder container.

2. A cleaning method for cleaning a powder container, the method comprising:

introducing a cleaning medium having a property to attract the powder by electrostatic force into the powder container from a first opening part of the powder container for attaching powder in the powder container to the cleaning medium, said cleaning medium being an aluminum ball having a substantially spherical shape, an electrostatic property, and a rebound resilience;

discharging the cleaning medium and the powder attracted to the cleaning medium by the electrostatic force from a second opening part situated opposite from the first opening part;

mounting plural powder containers on top of each other; and releasing the cleaning medium having the property to attract the powder by the electrostatic force from a position higher than the first opening part of the powder container.

3. The cleaning method as claimed in claim 2, wherein the powder containers are mounted on top of each other with one or more spacers provided therebetween.

4. The cleaning method as claimed in claim 1, further comprising a step of:

controlling the flow of the cleaning medium introduced into the first opening part by providing a flow control part inside the powder container.

5. The cleaning method as claimed in claim 3, further comprising a step of:

controlling the flow of the cleaning medium introduced into the first opening part by providing a flow control part inside the spacer.

6. A powder container, comprising:

a first opening part formed in a first end plane of the powder container for introducing a cleaning medium having a property to attract powder by electrostatic force therein, said cleaning medium being an aluminum ball having a substantially spherical shape, an electrostatic property, and a rebound resilience;

a second opening part formed in a second end plane of the powder container and situated opposite from the first opening part for discharging the cleaning medium from the powder container; and a flow control part for controlling the flow of the cleaning medium introduced from the first opening part.

7. The powder container as claimed in claim 6, wherein the flow control part is tapered in a direction where the cleaning medium is introduced into the first opening part.

8. The powder container as claimed in claim 6, wherein the flow control part includes a plurality of members extending in a radial direction.

9. The powder container as claimed in claim 6, wherein each of the first and second opening parts is provided with a connecting part.

10. The powder container as claimed in claim 9, wherein one of the connecting parts corresponding to one of the first and second opening parts is a concave part and the other one of the connecting parts corresponding to the other one of the first and second opening parts is a convex part.

11. The powder container as claimed in claim 9, wherein the connecting part of the first opening part has an inner diameter that is equal to the outer diameter of the connecting part of the second opening part.

12. The powder container as claimed in claim 6, wherein the first and second end planes are tapered, wherein the angle of the tapers is greater than the angle of repose of the cleaning medium.

13. The powder container as claimed in claim 6, wherein the powder container is configured to be disassembled into a plurality of components, wherein the components are connectable.

14. A cleaning apparatus for cleaning a powder container by introducing a cleaning medium having a property to attract powder by electrostatic force into the powder container from a first opening part of the powder container for attaching powder in the powder container to the cleaning medium and discharging the cleaning medium and the powder attracted to the cleaning medium by the electrostatic force from a second opening part situated opposite from the first opening part, the cleaning apparatus comprising:

a cleaning medium container for containing the cleaning medium having the property to attract powder by electrostatic force therein, said cleaning medium being an aluminum ball having a substantially spherical shape, an electrostatic property, and a rebound resilience; and a powder container holding mechanism for holding the powder container, wherein the cleaning medium container is situated at a position higher than the first opening part of the powder container for releasing the cleaning medium from a position higher than the first opening part of the powder container.

15. A cleaning apparatus for cleaning a powder container by introducing a cleaning medium having a property to attract powder by electrostatic force into the powder container from a first opening part of the powder container for attaching powder in the powder container to the cleaning medium and discharging the cleaning medium and the powder attracted to the cleaning medium by the electrostatic force from a second opening part situated opposite from the first opening part, the cleaning apparatus comprising:

a cleaning medium container for containing the cleaning medium having the property to attract powder by electrostatic force therein, said cleaning medium being an aluminum ball having a substantially spherical shape, an electrostatic property, and a rebound resilience; and a powder container holding mechanism for holding a plurality of the powder containers that are mounted on top of each other, wherein the cleaning medium container is situated at a position higher than the first opening part of the uppermost powder container among the plurality of powder containers for releasing the cleaning medium from a position higher than the first opening part of the uppermost powder container.

16. The cleaning apparatus as claimed in claim 14, further comprising:

a drive part, wherein the powder container includes a flow control part for controlling the flow of the cleaning medium introduced from the first opening part, and wherein the flow control part is driven by the drive part.

17. The cleaning apparatus as claimed in claim 15, wherein the powder containers are mounted on top of each other with one or more spacers provided therebetween.

18. The cleaning apparatus as claimed in claim 15, wherein the powder container holding mechanism includes a guide for matching positions of the powder containers.

19. The cleaning method as claimed in claim 1, wherein the cleaning medium is released from a cleaning medium container situated at a position higher than the first opening part of the powder container.

20. The cleaning method as claimed in claim 2, wherein the cleaning medium is released from a cleaning medium container situated at a position higher than the first opening part of the powder container.

* * * * *

UNITED STATES PATENT AND TRADEMARK OFFICE

CERTIFICATE OF CORRECTION

PATENT NO. : 7,758,700 B2
APPLICATION NO. : 11/573787
DATED : July 20, 2010
INVENTOR(S) : Fuchigami et al.

It is certified that error appears in the above-identified patent and that said Letters Patent is hereby corrected as shown below:

On the title page, Item (54) and column 1, the title is incorrect. Item (54) and column 1 should read:

-- (54) POWDER CONTAINER, CLEANING METHOD AND CLEANING APPARATUS FOR CLEANING THE POWDER CONTAINER --

Signed and Sealed this

Twenty-eighth Day of September, 2010

David J. Kappos

David J. Kappos
*Director of the United States Patent and Trademark Office*